US009394136B2

(12) United States Patent
Kubo et al.

(10) Patent No.: US 9,394,136 B2
(45) Date of Patent: Jul. 19, 2016

(54) SHEET BUNDLE BINDING PROCESSING APPARATUS AND IMAGE FORMING SYSTEM HAVING THE SAME

(71) Applicants: Mamoru Kubo, Yamanashi-ken (JP); Seiji Nishizawa, Yamanashi-ken (JP); Masaya Takahashi, Yamanashi-ken (JP)

(72) Inventors: Mamoru Kubo, Yamanashi-ken (JP); Seiji Nishizawa, Yamanashi-ken (JP); Masaya Takahashi, Yamanashi-ken (JP)

(73) Assignees: CANON FINETECH INC., Misato-Shi, Saitama-Ken (JP); NISCA CORPORATION, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 14/331,810

(22) Filed: Jul. 15, 2014

(65) Prior Publication Data

US 2015/0021374 A1 Jan. 22, 2015

(30) Foreign Application Priority Data

Jul. 17, 2013 (JP) ..... 2013-148089
Aug. 20, 2013 (JP) ..... 2013-170287

(51) Int. Cl.
*B65H 37/04* (2006.01)
*B65H 31/02* (2006.01)
(Continued)

(52) U.S. Cl.
CPC ..... *B65H 37/04* (2013.01); *B31F 5/001* (2013.01); *B65H 9/04* (2013.01); *B65H 31/02* (2013.01); *G03G 21/1633* (2013.01); *B65H 2801/27* (2013.01); *G03G 2215/00544* (2013.01); *G03G 2221/1672* (2013.01)

(58) Field of Classification Search
CPC ..... B65H 37/04; B65H 31/02; B65H 9/04; B65H 2801/27; G03G 21/1633; G03G 2221/1672; G03G 2215/00544
USPC ..... 270/37, 58.07, 58.08, 58.11, 58.12, 270/58.17
See application file for complete search history.

(56) References Cited

U.S. PATENT DOCUMENTS 5,342,034 A * 8/1994 Mandel ..... B42C 1/125 109/56
7,419,150 B2 * 9/2008 Kushida ..... B42C 1/12 270/58.07

(Continued)

FOREIGN PATENT DOCUMENTS

JP 2005-096392 A 4/2005
JP 2011-190021 A 9/2011
JP 2012-025499 A 2/2012

*Primary Examiner* — Leslie A Nicholson, III
(74) *Attorney, Agent, or Firm* — Manabu Kanesaka

(57) ABSTRACT

The purpose of the present invention is to provide a sheet bundle binding processing apparatus capable of performing a binding process in high productivity as selecting a binding processing unit from a staple binding device arranged in a sheet introducing area of a processing tray and a press binding device arranged outside the introducing area. The present invention comprises a sheet bundle binding processing apparatus including a processing tray on which sheets are stacked, an aligning device which aligns the sheets stacked on the processing tray, a first binding device which binds a sheet bundle stacked on the processing tray, a second binding device which binds a sheet bundle stacked on the processing tray having capability to bind a fewer number of sheets than that of the first binding device, and a controller which controls the aligning device so that a sheet bundle stacked on the processing tray is aligned at a position being apart from the second binding device by a predetermined distance before the sheet bundle is bound by the second binding device.

13 Claims, 25 Drawing Sheets

(51) Int. Cl.

| | |
|---|---|
| ***B65H 9/04*** | (2006.01) |
| ***G03G 21/16*** | (2006.01) |
| ***B31F 5/00*** | (2006.01) |

(56) References Cited

U.S. PATENT DOCUMENTS 8,104,757 B2 * 1/2012 Taki ..... B42B 4/00 270/58.08
8,246,033 B2 * 8/2012 Sato ..... B42C 1/12 270/58.07
8,342,499 B2 * 1/2013 Shiraishi ..... B65H 31/3027 270/52.18
8,413,979 B2 * 4/2013 Sato ..... B65H 37/04 270/58.07
8,444,133 B2 * 5/2013 Kimura ..... B42C 1/12 270/58.07
8,485,523 B2 * 7/2013 Kimura ..... B65H 31/26 271/220

* cited by examiner

Paddle-lifted position, Sheet discharging

Paddle-lowered position

Multi-binding

Right corner binding

Left corner binding

Manual binding

Eco-binding

Enlarged eco-binding part

Enlarged section at A-A

Back-swing position
Eco-binding position Ep
Eco-binding alignment position Ap2

27
27b
27c
46R
Sheet bundle 46R
27
Overrun amount 46R
27

27
46R
27b
27c

27
Sheet discharging
46R

Linear scar
sheet
46R
z
w

Guide waiting state

Guide aligning

Introduction

Alignment

Sheet bundle movement

Re-alignment

Binding process

Back

Kick

Movement

Discharge

SHEET BUNDLE BINDING PROCESSING APPARATUS AND IMAGE FORMING SYSTEM HAVING THE SAME

BACKGROUND OF THE INVENTION

1. Field of the Invention

The present invention relates to a sheet bundle binding processing apparatus to perform a binding process after collating and stacking sheets on which images are formed at an image forming apparatus in an image forming system, and relates to a sheet bundle binding processing apparatus capable of performing a binding process with a single binding device selected from a plurality of binding devices.

2. Description of Related Arts

In general, there has been widely known, in an image forming system, a post-processing apparatus (finisher) which performs a binding process on sheets with images formed thereon by an image forming apparatus after collating and stacking the sheets on a processing tray. For performing a binding process, there have been known a method to perform a binding process using a staple, a method to perform bonding with pressing to form a section into a corrugation shape, and a method to perform binding on a sheet bundle as forming a cutout portion and folding a side thereof.

A method to perform a binding process using a staple has an advantage that a relatively thick sheet bundle can be bonded reliably without being easily separated. However, the method has a problem for disposal of bound documents such as shredding thereof. A method to perform bonding with pressure deformation has advantages of being environment-friendly due to non-use of binding part such as a steel-made staple and being superior in noise-reduction and power-saving during operation. However, the method has problems, due to bonding weakness thereof, that the number of sheets to be bonded is limited and the bonding is easily released. Therefore, in general, such methods are selectively used for binding a sheet bundle in accordance with these features.

Japanese Patent Application Laid-open No. 2011-190021 (FIGS. 1 and 3) discloses an apparatus which is continuously connected to a sheet discharging port of an image forming apparatus. Here, image-formed sheets are introduced from an introducing path and stacked on a processing tray. A binding process is performed at the processing tray as selectively using either a stapling unit to perform binding with a staple or a press binding unit to perform bonding with pressure deformation, and then, the bound sheets are stored in a stack tray at the downstream side.

In this case, the stapling unit is supported by a guide rail to be movable along an end face of a sheet bundle positioned on the processing tray to provide two types of binding as being multi-binding to perform binding at a plurality of positions at a predetermined interval while moving and corner binding to perform binding at only one position being a corner of a sheet bundle. Further, the press binding unit is structured to bond a sheet bundle with pressure deformation as nipping the sheet bundle with an upper-lower pair of pressurizing faces having convex grooves and concave grooves.

Japanese Patent Application Laid-open No. 2012-025499 (FIG. 2) discloses an apparatus being similar to the above. In this apparatus, a post-processing is selectively performed as performing a binding process using a staple or without using a staple on sheets fed from an image forming apparatus and stacked on a processing tray, and then, the sheets are discharged to a stack tray at the downstream side.

Further, Japanese Patent Application Laid-open No. 2005-096392 (FIG. 3) discloses an apparatus including a stage arranged at a body casing, the stage having a slit-shaped groove to which a sheet bundle is inserted. Here, after sheets fed from an image forming apparatus are collated and stacked on a stack tray, an operator inserts the sheet bundle to the stage so that a binding process is performed thereon with a stapling unit arranged inside the body casing.

SUMMARY OF THE INVENTION

Here, when two binding devices are arranged on the processing tray, there may be a problem of causing sheet jamming while sheets passing on the processing tray are abutted to a binding device.

In view of the above, an object of the present invention is to provide a sheet bundle binding processing apparatus capable of performing a binding process as selecting a binding processing unit from different binding processing units which are arranged within a sheet introducing area and outside the sheet introducing area of a processing tray.

In this specification, "offset conveyance of a sheet bundle" denotes to move (bias) a sheet bundle (sheets introduced from a sheet discharging port) in a direction perpendicular to (or intersecting with) a sheet conveyance direction. "Offset amount" denotes a movement amount thereof. "Alignment of a sheet bundle" denotes to align sheets having different sizes introduced from a sheet discharging port in accordance with reference (center reference or side reference). Accordingly, "offset after sheet alignment" denotes to move the whole sheets in a direction perpendicular to the sheet conveyance direction after the sheets having different sizes are aligned in reference.

To address the above issues, the present invention provides a sheet bundle binding processing apparatus including a processing tray on which sheets are stacked, an aligning device which aligns the sheets stacked on the processing tray, a first binding device which binds a sheet bundle stacked on the processing tray, a second binding device which binds a sheet bundle stacked on the processing tray having capability to bind a fewer number of sheets than that of the first binding device, and a controller which controls the aligning device so that a sheet bundle stacked on the processing tray is aligned at a position being apart from the second binding device by a predetermined distance before the sheet bundle is bound by the second binding device.

Further, in the present invention, the sheet bundle bound by the second binding device is discharged the downstream side after the sheet bundle is offset again by a sheet bundle offset device by a predetermined amount toward a sheet center side as intersecting with a bundle discharging direction. Here, the offset amount at that time is set smaller (to have a shorter distance) than the offset amount after processing.

Further, in the present invention, the respective binding devices are arranged so that staple binding or press binding without using a staple is selectable to be performed on sheets collated and stacked on the processing tray after being fed from the sheet discharging path. For performing a binding process on sheets having different lengths in the direction perpendicular to the sheet discharging direction, sheets are aligned on the processing tray in center reference in a mode to perform staple binding on a plurality of positions, sheets are aligned in side reference in a mode to perform staple binding on a single sheet corner, and sheets are positioned at a binding position with the sheet bundle being moved in the direction perpendicular to the sheet discharging direction after the sheets are aligned in side reference or center reference in a mode to perform press binding on a single sheet corner.

The present invention provides a reliable sheet bundle binding processing apparatus in which sheet jamming with sheets abutted to the second binding device is prevented while the sheets fed from the upstream side are to be stacked on the processing tray. Further, since the second binding device having capability to bind a fewer number of sheets is arranged outside the sheet introducing area, the number of sheets to be moved toward the second binding device is small. Accordingly, it is possible to prevent positional deviation among the stacked sheets due to collapsing of a sheet bundle with the movement.

BRIEF DESCRIPTION OF THE DRAWINGS

FIGS. 4A and 4B are explanatory views of a sheet introducing mechanism of the apparatus of FIG. 2, while FIG. 4A illustrates a state that a paddle rotor is at a waiting position and FIG. 4B illustrates a state that the paddle rotor is at an engaging position;

FIGS. 10A to 10C illustrate states of the staple binding unit at binding positions, while FIG. 10A illustrates a state at a right corner binding position, FIG. 10B illustrates a state at a staple loading position, and FIG. 10C illustrates a state at a manual binding position;

FIGS. 11A to 11D are explanatory views of a sheet bundle discharging device in the apparatus of FIG. 2, while FIG. 11A illustrates awaiting state, FIG. 11B illustrates a transitional conveying state, FIG. 11C illustrates a structure of a second conveying member, and FIG. 11D illustrates a state of discharging to a stack tray;

FIGS. 12A to 12G are explanatory views of a binding processing method of a sheet bundle, while FIG. 12A illustrates a multi-bound state, FIG. 12B illustrates a bound state at the right corner, FIG. 12C illustrates a bound state at the left corner, FIG. 12D illustrates a manual-bound state, FIG. 12E illustrates an eco-binding state, FIG. 12F illustrates an enlarged eco-binding part, and FIG. 12G illustrates an enlarged sectional view thereof along the line A-A in FIG. 12F.

FIGS. 15A to 15F are explanatory operational views of a kick device in the apparatus of FIG. 2, while FIG. 15A illustrates a state in which an eco-binding alignment position is set at the same position as the eco-binding alignment position Ap2, FIG. 15B illustrates a state in which the binding process controller causes the side aligning plate to move, FIG. 15C illustrates a state in which the side aligning plate move into a back swing position, FIG. 15D illustrates a state in which the binding process controller causes the side aligning plate to move toward the sheet center, FIG. 15E illustrates a state in which the sheet bundle pressure-nipped is taken off and offset to the sheet center side, and FIG. 15F illustrates a state in which a conveyance force is applied in a direction of arrow z and arrow w;

FIGS. 16A and 16B are explanatory operational views of a paper guide mechanism in the apparatus of FIG. 2, while FIG. 16A illustrates a state that a guide is retracted and FIG. 16B illustrates a state that the guide is engaged;

DETAILED DESCRIPTION OF THE PREFERRED EMBODIMENT

Figure 1:
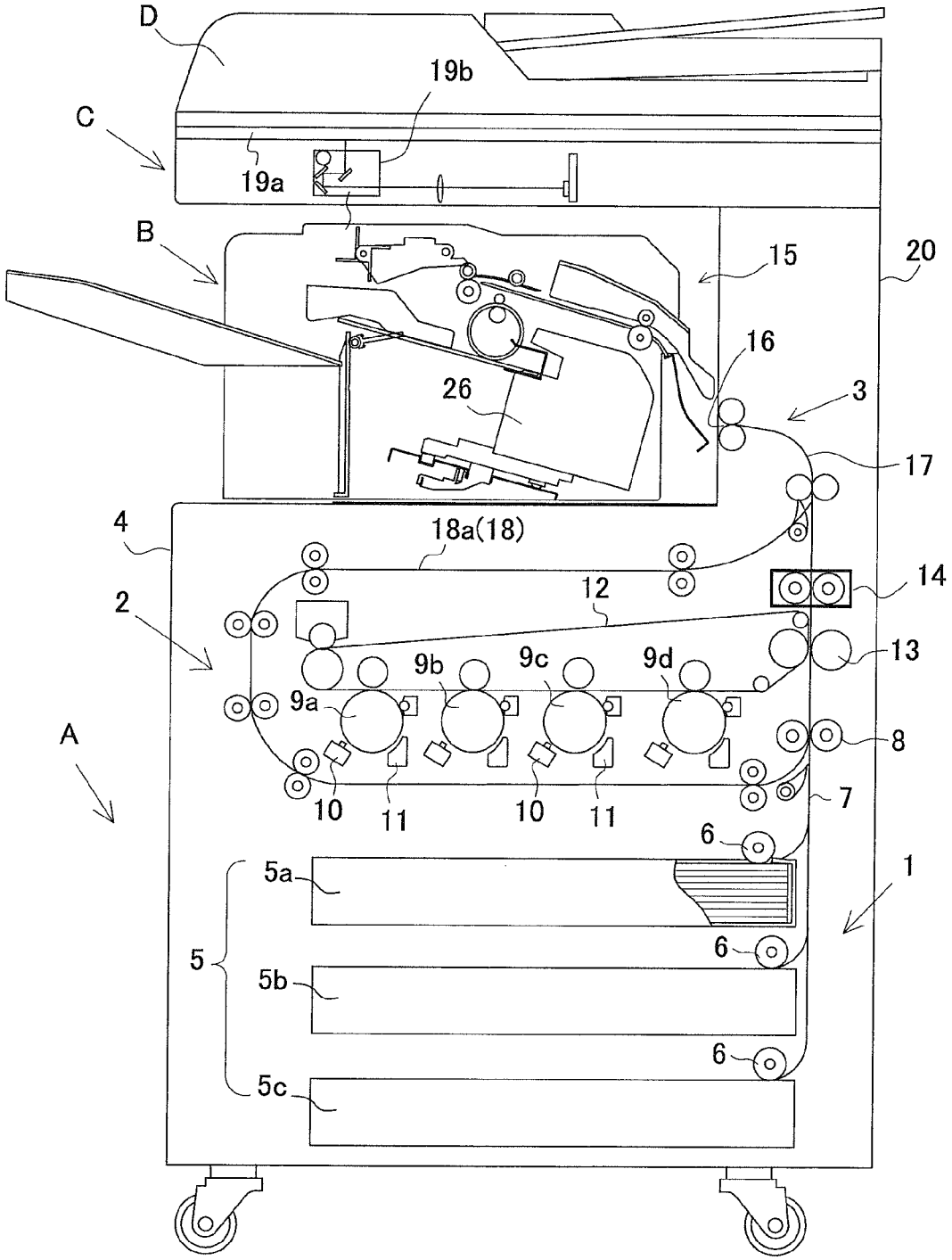
FIG. 1 is an explanatory view of a whole configuration of an image forming system according to the present invention.

In the following, the present invention will be described in detail based on preferred embodiments illustrated in the drawings. FIG. 1 schematically illustrates a side view of a whole configuration of an image forming system. The image forming system includes an image forming unit A, a post-processing unit B, and an image reading unit C which are incorporated in an apparatus housing 20. In the present invention, the image forming system may have a stand-alone structure that the image forming unit A, the post-processing unit B, and the image reading unit C are independently arranged and the respective units are connected by network cables to be systematized.

In such an image forming system, images read by the image reading unit C are formed continuously on a plurality of sheets by the image forming unit A. Here, a sheet bundle binding processing apparatus according to the present invention is assembled to the image forming system as the post-processing unit B which performs a binding process on the sheets fed from the image forming unit A.

[Sheet Bundle Binding Processing Apparatus]

Figure 2:
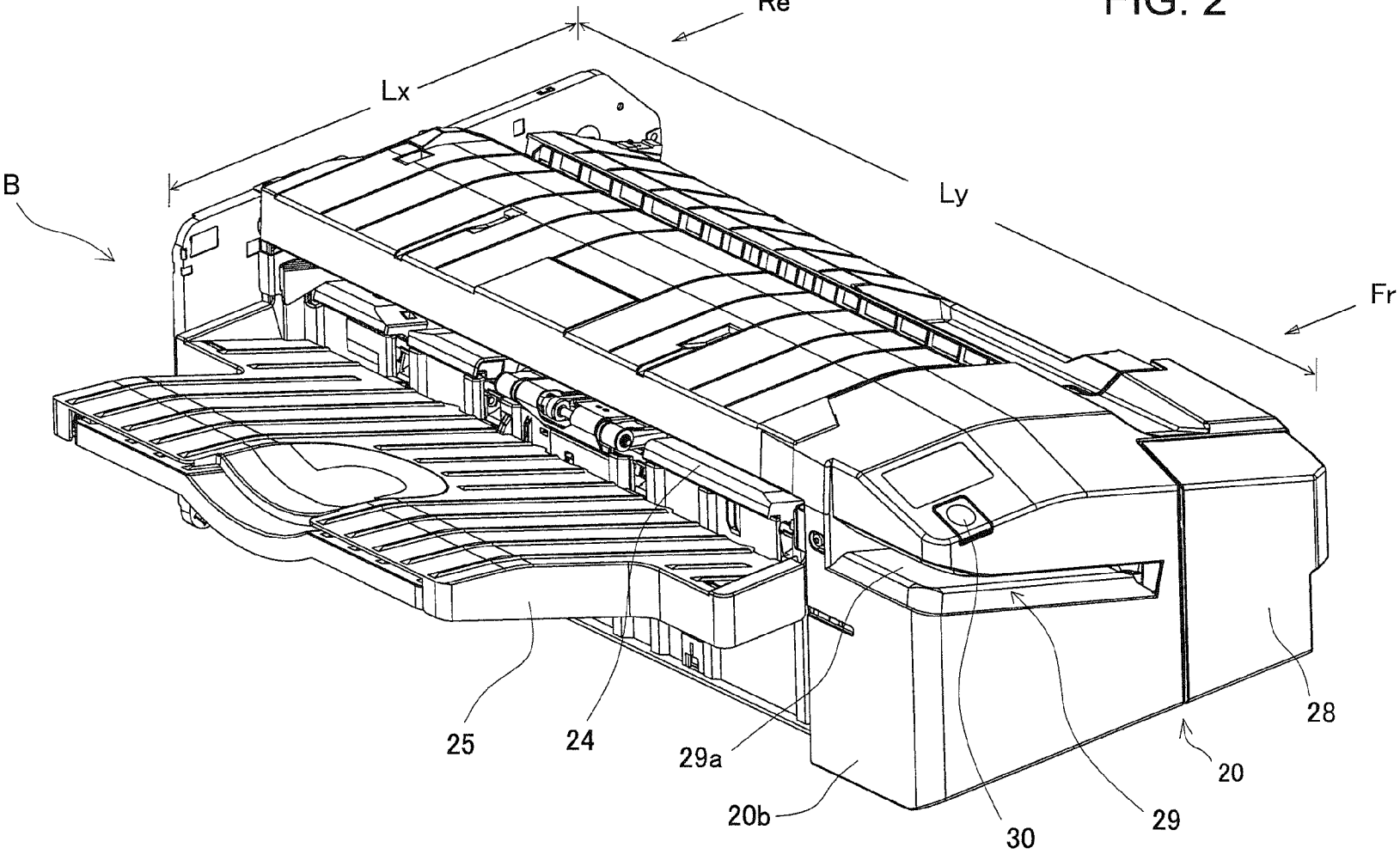
FIG. 2 is an explanatory perspective view illustrating a whole configuration of a post-processing apparatus in the image forming system of FIG. 1.
Figure 3:
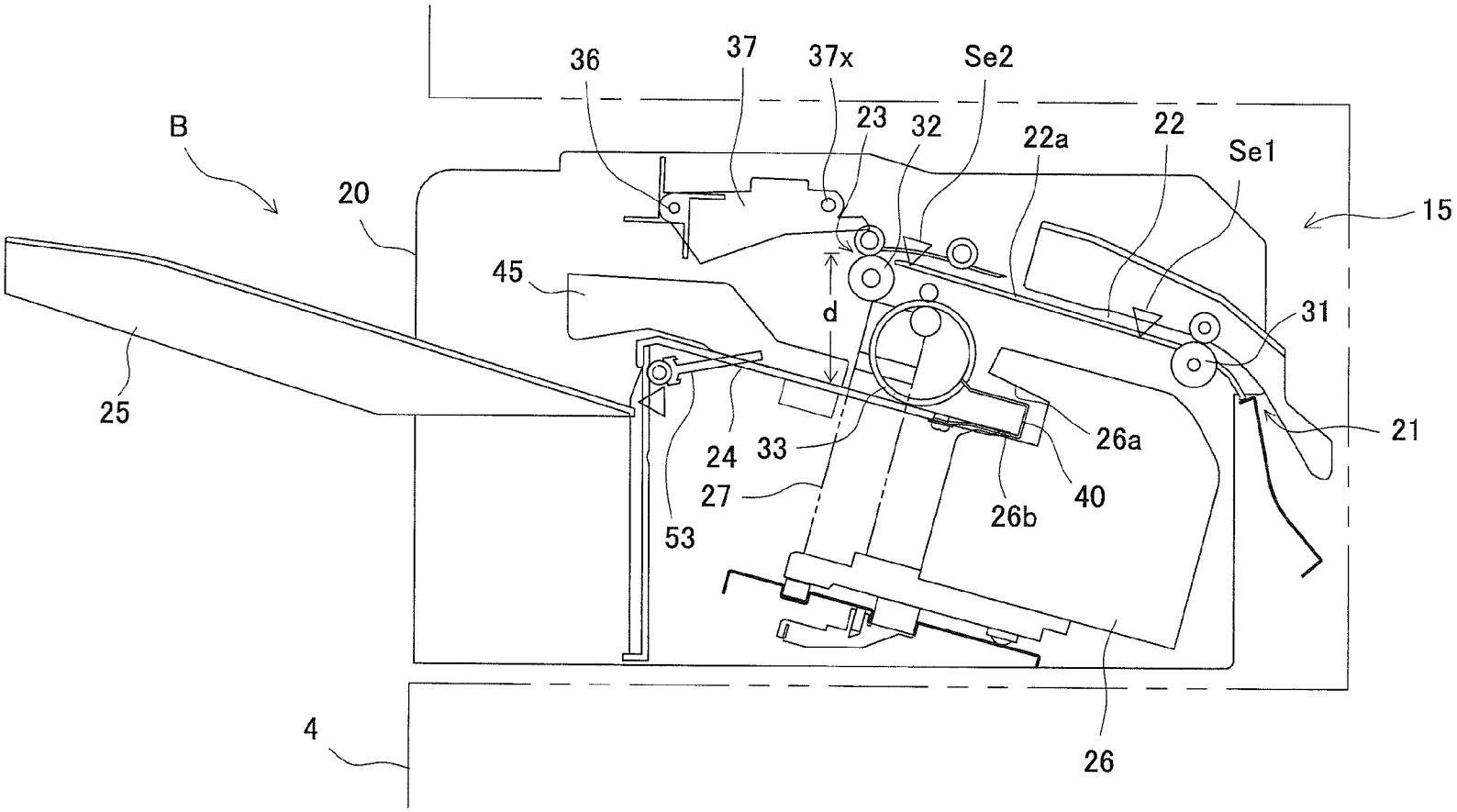
FIG. 3 is a side sectional view (at an apparatus front side) of the apparatus of FIG. 2.

FIGS. 2 and 3 are an external perspective view and a sectional side view of the post-processing unit B, respectively. An external casing 20*b* of the apparatus housing 20 has a monocoque structure obtained by integrating, with mold processing using resin or the like, a right-left pair of side frames 20*c*, 20*d* (FIG. 5) and a bottom frame 20*e* (FIG. 7) which connects the side frames 20*c*, 20*d*. The right-left pair of side frames 20*c*, 20*d* support a binding mechanism, a conveying mechanism, a tray mechanism, and a drive mechanism which are described later. Here, a part thereof at an apparatus front side is exposed to be operable from the outside. Then, a cartridge mount opening 28 for staples, a manual setting portion 29, a manual operation button 30 (in the drawing, a switch having a built-in indication lamp) which are described later are arranged thereat. Further, the external casing 20*b* has a length Lx in a sheet movement direction and a length Ly in a direction perpendicular to the sheet movement direction, that is, to the sheet width direction, which are set based on the maximum sheet size, as being smaller than a later-mentioned sheet discharge space 15 of the image forming unit A.

The sheet bundle binding processing apparatus includes a sheet introducing path 22 which is arranged in the apparatus housing 20 as having an introducing port 21 and a discharging port 23, a processing tray 24 which is arranged at the downstream side of the discharging port 23, and a stack tray 25 which is arranged at the downstream side of the processing tray 24.

A paddle rotor 36 being an introducing device to introduce sheets, a regulating device 40 to regulate introduced sheets stacked into a bundle shape as being abutted to a rear end edge of the sheets, and an aligning device 45 are arranged at the processing tray 24. Further, a staple binding unit 26 (first binding device) to bind a sheet bundle using a staple and a press binding unit 27 (second binding device) to bind a sheet bundle without using a staple by pressing the sheet bundle so that a section thereof becomes into a corrugated state are arranged at the processing tray 24. Here, not limited to the press binding unit 27, the second binding device may adopt a variety of binding devices such as forming a folded portion by folding or holing a sheet bundle and using adhesive being glue or the like. Thus, since the second binding device operates without using a staple as being advantageous in resource saving, the binding process with the second binding device is hereinafter called eco-binding.

[Sheet Introducing Path (Sheet Discharging Path)]

The sheet introducing path 22 receives a sheet from the image forming unit A, conveys the sheet approximately in the horizontal direction, and discharges the sheet from the sheet discharging port 23 to the processing tray 24. The sheet introducing path 22 is called a sheet discharging path 22 in the following description. The sheet discharging path 22 includes an appropriate guide plate 22*a* and incorporates a feeder mechanism which conveys a sheet. The feeder mechanism is structured with pairs of conveying rollers arranged at predetermined intervals in accordance with a path length. In FIG. 3, a pair of introducing rollers 31 are arranged in the vicinity of the introducing port 21 and a pair of discharging rollers 32 are arranged in the vicinity of the discharging port 23. A sheet sensor Se1 to detect a sheet leading end and/or a sheet tailing end is arranged at the sheet discharging path 22.

The sheet discharging path 22 includes a linear path arranged approximately in the horizontal direction along a plane of the apparatus housing 20. Here, a sheet is prevented from receiving stress which is caused by a curved path. Accordingly, the sheet discharging path 22 is formed as having linearity which is allowed by apparatus layout. The pair of introducing rollers 31 and the pair of discharging rollers 32 are connected to the same driving motor M1 (hereinafter, called a conveying motor) and convey a sheet at the same circumferential speed.

[Processing Tray]

As illustrated in FIG. 3, the processing tray 24 is arranged at the downstream side of the sheet discharging port 23 of the sheet discharging path 22 as forming a step d therefrom. For upward stacking of sheets fed from the sheet discharging port 23 into a bundle shape, the processing tray 24 includes a sheet placement face 24*a* which supports at least a part of the sheets. FIG. 3 illustrates a structure (bridge-support structure) in which a sheet leading end side is supported by the later-mentioned stack tray 25 and a sheet tailing end side is supported by the processing tray 24. Thus, the processing tray 24 is downsized.

The processing tray 24 is structured so that sheets fed from the sheet discharging port 23 are stacked into a bundle shape, and a binding process is performed after the sheets are aligned into a predetermined posture, and the processed sheet bundle is discharged to the stack tray 25 at the downstream side. Accordingly, a sheet introducing device, the aligning device 45, the binding processing mechanisms 26, 27, and a sheet bundle discharging device 60 are arranged at the processing tray 24.

[Sheet Introducing Device]

In the drawings, the sheet introducing device includes the paddle rotor 36 which is lifted and lowered. A sheet discharged from the sheet discharging port 23 is conveyed by the paddle rotor 36 toward the regulating device 40 in a direction (rightward in FIG. 3) opposite to the discharging direction by the sheet introducing device. The leading end of the conveyed sheet is aligned as being abutted to the regulating device 40, so that positioning of the sheet is performed. In the following description, unless otherwise noted, the sheet discharging direction denotes a direction in which a sheet is conveyed toward the regulating device 40 and the direction perpendicular to the sheet discharging direction denotes a direction perpendicular to the sheet movement direction, that is, the sheet width direction.

In the sheet introducing device, a lifting-lowering arm 37 which is axially-supported swingably by a support shaft 37*x* at the apparatus frame 20*a* is arranged and the paddle rotor 36 is axially-supported rotatably at a top end part of the lifting-lowering arm 37. A pulley (not illustrated) to which the abovementioned conveying motor M1 is connected is arranged at the support shaft 37*x*.

In addition, a paddle lifting-lowering motor M3 is connected to the lifting-lowering arm 37 via a spring clutch (torque limiter) and is structured so that the lifting-lowering arm 37 is lifted and lowered with rotation of the lifting-lowering motor M3 between a waiting position Wp at the upper side and an operating position (sheet engaging position) Ap at the lower side. That is, the spring clutch lifts the lifting-lowering arm 37 from the operation position Ap to the waiting position Wp with rotation of the paddle lifting-lowering motor M3 in one direction and keeps the lifting-lowering arm 37 waiting at the waiting position Wp after abutting to a stopper (not illustrated). On the contrary, the spring clutch is released with rotating of the paddle lifting-lowering motor M3 in the opposite direction, so that the lifting-lowering arm 37 is lowered under own weight thereof from the waiting position Wp to the operating position Ap at the lower side to be engaged with the upmost sheet on the processing tray 24.

Figure 5:
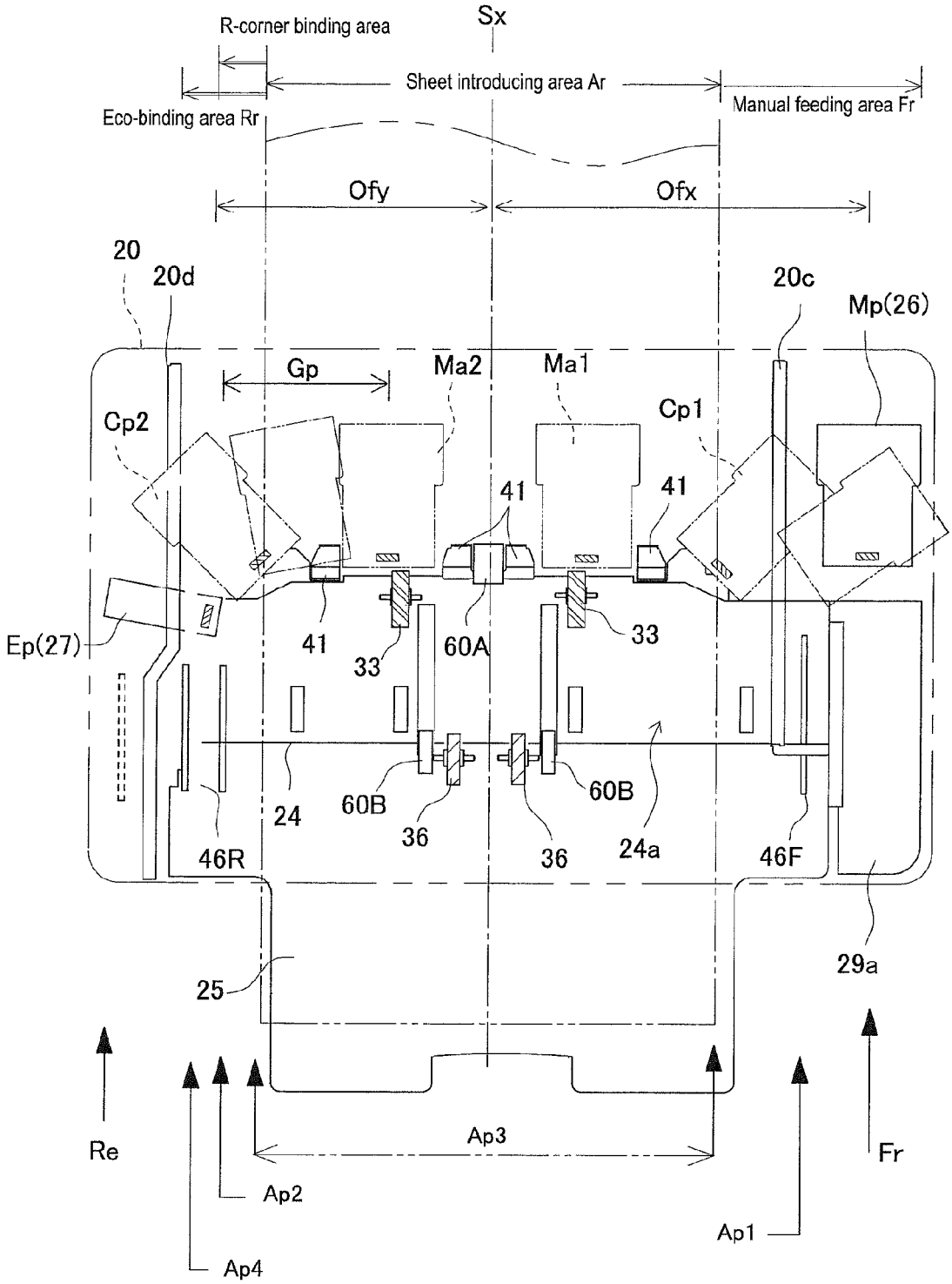
FIG. 5 is an explanatory plan view illustrating an arrangement relation among respective areas and alignment positions in the apparatus of FIG. 2.

As illustrated in FIG. 5, a pair of the paddle rotors 46 are arranged in a bilaterally symmetric manner at a predetermined interval with respect to the center Sx of a sheet fed from the discharging port 23 (that is, in center reference). Alternatively, three paddle rotors in total may be arranged at the sheet center and both sides thereof, or one paddle rotor may be arranged at the sheet center.

The paddle rotor 36 which pushes out a sheet with friction against the sheet is structured with a flexible rotor formed of a plate-shaped member, plastic-made blade member, or the like. Instead of the paddle rotor 36, it is possible that the sheet introducing device is structured with a friction rotating member such as a roller body and a belt body. The illustrated apparatus includes the mechanism with which the paddle rotor 36 is lowered from the waiting position Wp at the upper side to the operating position Ap at the lower side after a sheet tailing end is discharged from the discharging port 23. However, instead of the above, it is possible to adopt a lifting-lowering mechanism described below.

With a lifting-lowering mechanism being different from the illustrated mechanism, for example, when a sheet leading end is discharged from the discharging port 23, a friction rotor is lowered from a waiting position to an operating position and rotated concurrently in the sheet discharging direction. Then, at the timing when a sheet tailing end is discharged from the discharging port 23, the friction rotor is reversely rotated in a direction opposite to the sheet discharging direction. According to the above, it is possible that the sheet discharging from the discharging port 23 is conveyed to a predetermined position of the processing tray 24 at high speed without being skewed.

[Raking Rotor]

Figure 4A:
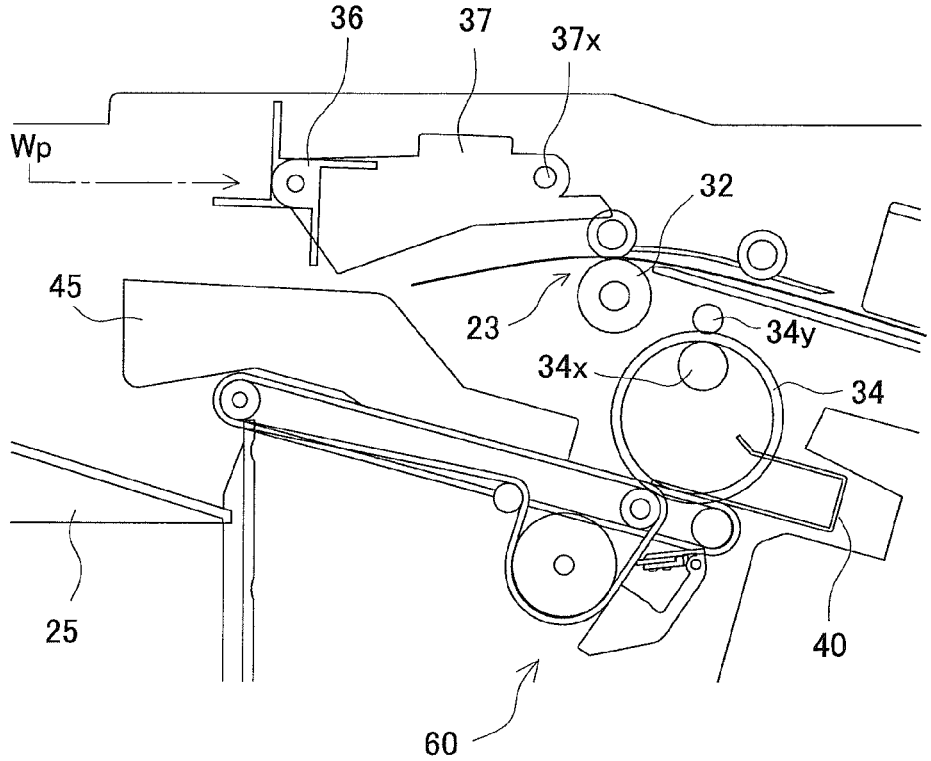
Figure 4B:
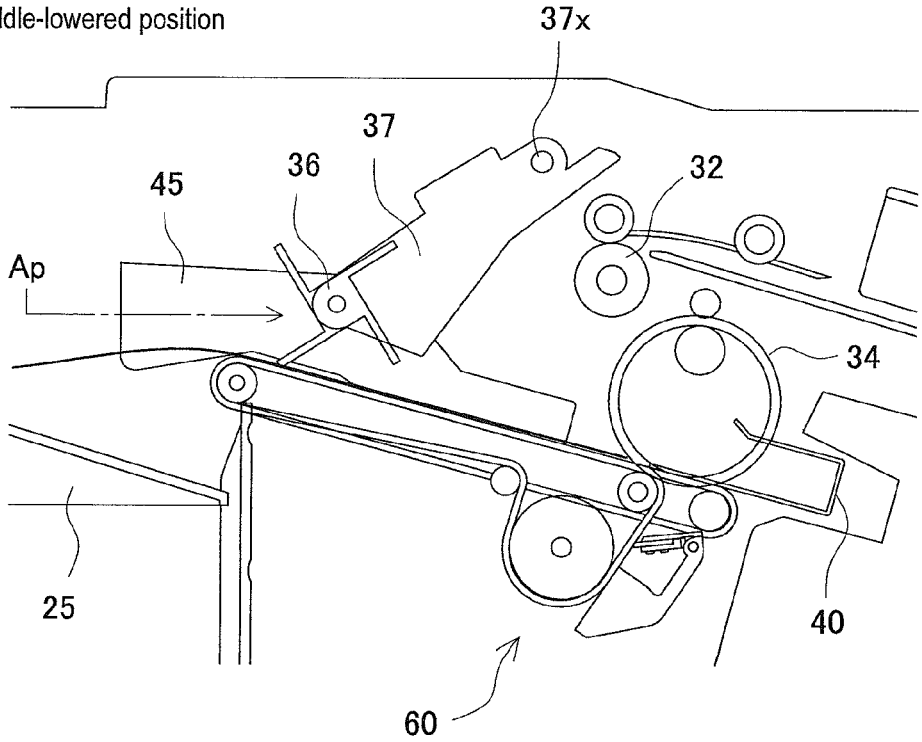

A raking rotor 33 is arranged so that a sheet tailing end (a leading end in the sheet discharging direction) of a curled sheet or a skewed sheet is reliably guided to the regulating device 40 at the downstream side when a sheet is conveyed to a predetermined position of the processing tray 24 by the puddle rotor 36. The raking rotor 33 is arranged below the pair of sheet discharging rollers 32 and guides a sheet fed by the paddle rotor 36 to the regulating device 40. The raking rotor 33 is structured with a ring-shaped belt member 34 (FIG. 4) and conveys the upmost sheet on the processing tray 24 to the regulating device 40 as being abutted thereto.

The belt member 34 is structured with a roulette belt or the like having a high frictional force made of soft material such as rubber material. The belt member 34 is nipped and supported between an idling shaft 34*y* and a rotating shaft 34*x* which is connected to a drive motor (in the drawing, the conveying motor M1 is commonly used). A rotational force in the counterclockwise direction in FIG. 3 is applied from the rotating shaft 34*x*, so that the raking rotor 33 presses a sheet introduced along the upmost sheet stacked on the processing tray 24 and causes a leading end of the sheet to be abutted to the regulating device 40 at the downstream side.

Further, the raking rotor 33 is configured to be moved upward and downward against the upmost sheet on the processing tray 24 by a roulette lifting-lowering motor M5. Here, description of a lifting-lowering mechanism therefor is skipped. Then, the raking rotor 33 is lowered and abutted to an introduced sheet at the timing when the sheet leading end enters between a face of the belt member 34 of the raking rotor 33 and the upmost sheet at that time, so that the sheet as the upmost sheet is introduced toward the regulating device 40. On the other hand, when a sheet bundle is conveyed by the later-mentioned sheet bundle discharging device 60 from the processing tray 24 to the stack tray 25 at the downstream side, the raking rotor 33 is lifted as being separated from the upmost sheet with driving of the roulette lifting-lowering motor M5. Thus, as illustrated in FIG. 5, sheets are introduced from the sheet discharging path 22 to the processing tray 24 with reference to the sheet center Sx. At the processing tray 24, the aligning device 45 sets the reference in accordance with a processing mode to be aligned in center reference or side reference.

[Aligning Device]

The aligning device 45 which aligns and positions a sheet introduced with operation of the raking rotor 33 at a reference position in the direction perpendicular to the sheet discharging direction is arranged at the processing tray 24. The aligning device 45 in the drawing includes the regulating device 40 which positionally regulates a sheet fed from the discharging port 23 to the processing tray 24 with a tailing end (in the sheet discharging direction, a leading end) edge of the sheet abutted thereto, and a side regulating member which biases and aligns a sheet in the direction perpendicular to the sheet discharging direction.

[Regulating Device]

The illustrated regulating device 40 includes tailing end regulating members 41 (FIGS. 5 and 6) which are abutted to a tailing end of a sheet. The tailing end regulating members 41 cause a sheet moving along the sheet placement face 24*a* on the processing tray 24 with an end face of the leading end thereof abutted to regulating faces 41*a* respectively.

After the regulating device 40 performs positioning of the sheet tailing end edge with the tailing end regulating member 41, the later-mentioned staple binding unit 26 is moved along the sheet tailing end and performs staple binding on the sheets. Here, the location of the tailing end regulating member 41 may cause obstruction against movement of the staple binding unit 26. To prevent obstruction against movement of the staple binding unit 26, following three structures may be considered.

(1) The tailing end regulating member 41 is configured to have a mechanism to proceed to and retract from a movement path of the staple binding unit 26.

(2) The tailing end regulating member 41 is configured to have a mechanism to be moved integrally with the staple binding unit 26.

Figure 13A:
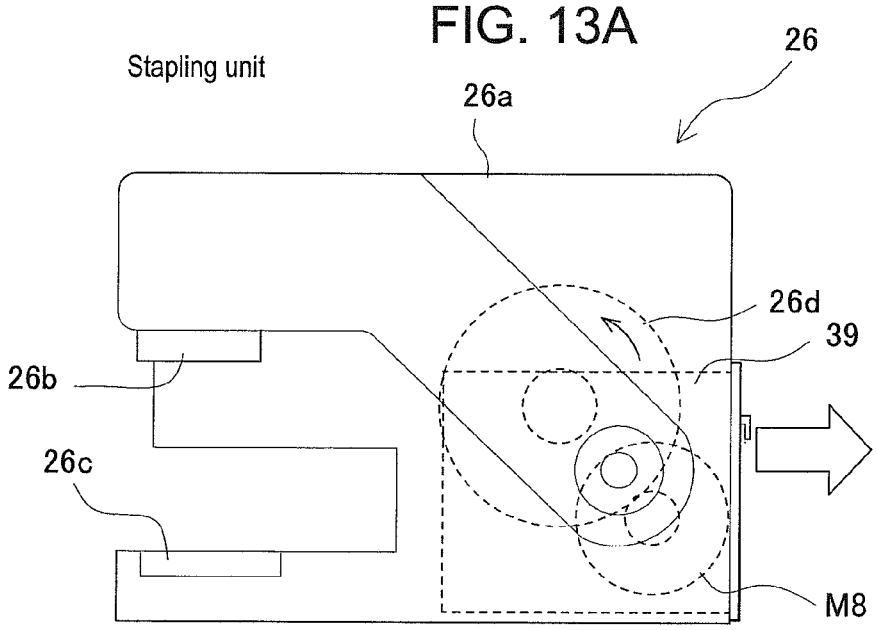
FIG. 13A is a structural explanatory view of the staple binding unit and FIG. 13B is a structural explanatory view of a press binding unit.

(3) The tailing end regulating member 41 is configured to have a shape to be fitted in a space (binding space) which is formed when a staple head 26*b* and an anvil member 26*c* of the staple binding unit 26 (FIG. 13) are in an opened state.

The illustrated tailing end regulating member 41 is formed by folding both ends of a plate member to have a channel-shaped section and external dimensions thereof are set to be fitted into the binding space of the staple binding unit 26 as adopting the configuration of (3) described above. Then, the tailing end regulating member 41 is attached with a folded portion at the lower side fixed to a back wall of the processing tray 24 with screws. An inclined face 41*b* (FIG. 7) which guides a sheet end to the regulating face is formed at the folded portion at the upper side.

[Side Regulating Member]

The side regulating member includes a right-left pair of side aligning plates 46F, 46R. Slit grooves 24*x* penetrating the sheet placement face 24*a* are formed at the processing tray 24. The right side aligning member 46F and the left side aligning member 46R are fitted to the slit grooves 24*x* and attached to the processing tray 24 as protruding thereabove. Each of the side aligning plates 46F, 46R is integrally formed with a rack 47 and is slidably supported by a plurality of guide rollers 49 (or rail members) at the back face side of the processing tray 24. Aligning motors M6, M7 are connected to the right-left racks 47 respectively via a pinion 48. The right-left aligning motors M6, M7 are structured with stepping motors. Positions of the right-left aligning plates 46F, 46R are detected by position sensors (not illustrated). Based on the detected values, the side aligning plates 46F, 46R can be moved respectively in either right or left direction by specified movement amounts.

The side aligning plates 46F, 46R slidable on the sheet placement face 24*a* have regulating faces 46*x* which abut to side edges of a sheet. Here, the regulating faces 46*x* can reciprocate by a predetermined stroke mutually in a closing direction or a separating direction. The stroke is determined from difference between the maximum sheet size and the minimum sheet size and the offset amount of positional movement (offset conveyance) of an aligned sheet bundle rightward or leftward. That is, the movement stroke of the right-left side aligning plates 46F, 46R is determined from a movement amount for aligning sheets having different sizes and the offset amount of the aligned sheet bundle. Here, not limited to the illustrated rack-pinion mechanism, it is also possible to adopt a structure that the side aligning plates 46F, 46R are fixed to a timing belt and the timing belt is connected to a motor via a pulley to reciprocate laterally.

According to the above structure, a later-mentioned binding process controller 75 causes the right-left side aligning plates 46F, 46R to wait at predetermined waiting positions (distanced by a sheet width +α therebetween) based on sheet size information which is provided from the image forming unit A or the like. In the above state, a sheet is introduced onto the processing tray 24. At the timing when a sheet end is abutted to the sheet end regulating member 41, aligning operation is started. In the aligning operation, the right-left aligning motors M6, M7 are rotated in opposite directions (closing directions) by the same amount. Accordingly, sheets introduced onto the processing tray 24 are stacked in a bundle shape as being positioned at an alignment position Ap3 in FIG. 5 in reference to the sheet center Sx. According to repetition of the introducing operation and the aligning operation, sheets are collated and stacked on the processing tray 24 in a bundle shape. Here, sheets of different sizes are positioned in center reference. Thus, when the sheets stacked on the processing tray 24 are aligned in center reference, a multi-binding process to perform binding at a plurality of positions of the sheet tailing end edge at a predetermined interval can be performed.

Further, the side regulating member structured with the side aligning plates 46F, 46R can perform realignment in side reference having a side edge as the reference on a sheet bundle which is introduced and stacked to the processing tray 24 in center reference. Three positions Ap1, Ap2, Ap4 are adoptable as the alignment position in side reference. First, the alignment position Apt is a position for aligning in right side reference having the right side edge as the reference when performing F-corner binding to perform staple binding performed on a corner at the apparatus front side Fr of sheets introduced to the processing tray 24.

Further, the alignment position Ap2 is a position for aligning in left side reference having the left side edge as the reference when performing R-corner binding to perform staple binding on a corner at the apparatus rear side Re of sheets introduced to the processing tray 24.

Further, the alignment position Ap4 is a position for aligning in left side reference having the left side edge as the reference when the eco-binding process is performed on a corner at the apparatus rear side Re of sheets introduced to the processing tray 24. In the present example, an alignment position Ap5 for jog-sorting sheets introduced to the processing tray 24 is matched with the alignment position Ap1.

When aligning is performed in side reference, the right-left side aligning plates 46F, 46R are moved toward one side of the processing tray 24 being distanced by a sheet width under control of the binding process controller 75. At that time, moved positions of the right-left side aligning plates 46F, 46R are detected by position sensors such as position sensors and encode sensors. In accordance with the above, driving of the aligning motors M6, M7 structured with stepping motors are PWM-controlled to control movement of the side aligning plates 46F, 46R.

[Method of Binding Process (Binding Position)]

As described above, sheets conveyed to the introducing port 21 of the sheet discharging path 22 are collated and stacked on the processing tray 24 and aligned by the regulating device 40 and the side aligning plates 46F, 46R at the previously-set position and in the previously-set posture. Thereafter, the sheet bundle is bound by the staple binding unit 26 or the press binding unit 27. In the following, a method of the binding process is described.

Multi-binding positions Ma1, Ma2 where sheets are staple-bound at a plurality of positions, corner binding positions Cp1, Cp2 where sheets are bound at a corner, a manual binding position Mp where a binding process is performed on manually-set sheets, and an eco-binding position Ep where sheets are bound at a corner by the press binding unit 27 without using a staple are defined for performing a binding process with the staple binding unit 26 or the press binding unit 27 on a sheet bundle aligned into a bundle shape in center reference by the side aligning plates 46F, 46R. In the following, positional relation among the respective binding positions will be described.

[Multi-Binding]

Figure 12A:
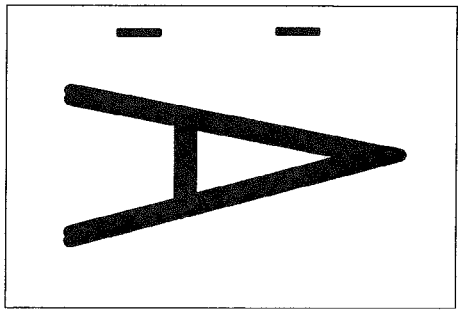

As illustrated in FIG. 5, in the multi-binding process, a sheet bundle positioned by the regulating device 40 and the side aligning plates 46F, 46R is bound at a tailing end edge thereof by the staple binding unit 26 at two positions being the binding positions Ma1, Ma2 which are mutually distanced. As described later, the staple binding unit 26 is moved from a home position to the binding position Ma1 and the binding position Ma2 in the order thereof and performs a binding process respectively at the binding positions Ma1, Ma2. FIG. 12A illustrates a multi-bound state. Not limited to the two positions Ma1, Ma2, the binding process may be performed at three or more positions as the multi-binding positions.

[Corner Binding]

Figure 12B:
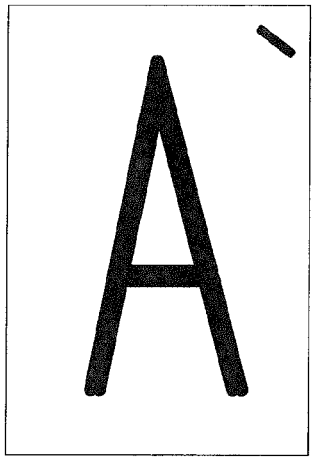
Figure 12C:
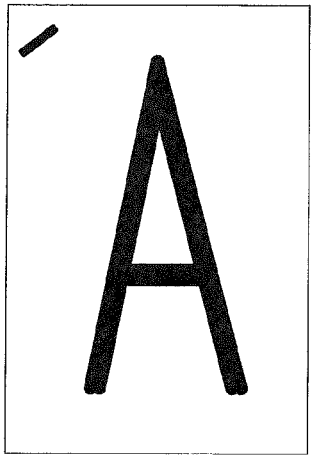

In the corner binding process, a sheet bundle positioned by the regulating device 40 and the side aligning plates 46F, 46R is bound at a right corner of a tailing end edge thereof by the staple binding unit 26. In this case, the binding process is performed with a staple being oblique by a predetermined angle, for example, in a range between 30 and 60 degrees. As described later, in this case, the staple binding unit 26 is configured to be swung by the angle as a whole unit at the binding position Cp1 or the binding position Cp2. FIGS. 12B and 12C illustrate bound states respectively at the right corner and the left corner.

FIGS. 12B and 12C illustrate cases that the binding process is performed on either the right or left of a sheet bundle by selection while a staple is set oblique by the predetermined angle. However, not limited to the above, it is also possible to adopt a structure that the binding is performed with a staple being parallel to a sheet end edge without being oblique.

[Manual Binding]

Figure 12D:
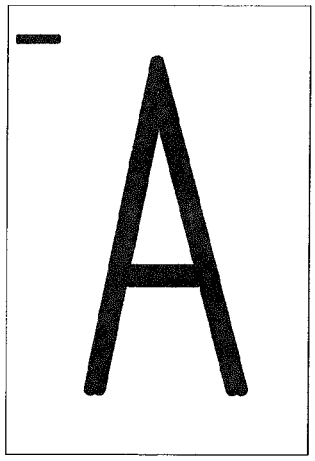
Figure 12E:
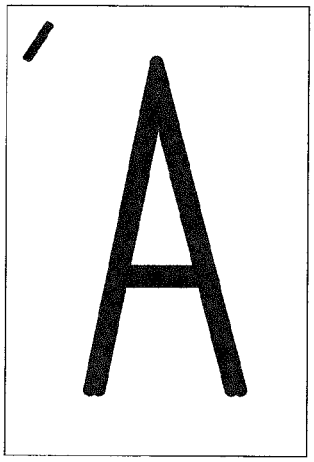
Figure 12F:
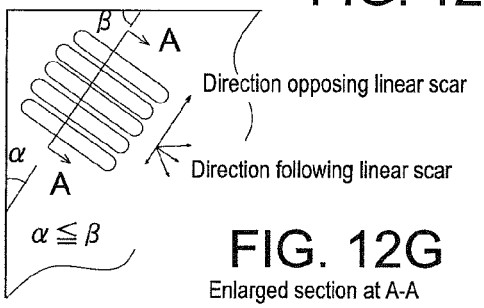

In the illustrated apparatus, it is possible to perform a manual stapling process to bind sheets prepared outside the apparatus with the staple binding unit 26. Here, the manual setting portion 29 is arranged for setting a sheet bundle to the external casing 20*b* from the outside. A manual setting face 29*a* on which a sheet bundle is set is formed at the casing. The staple binding unit 26 is configured to be moved from a sheet introducing area Ar to a manual-feeding area Fr of the processing tray 24. The manual setting face 29*a* is arranged in parallel at a position being adjacent to the sheet placement face 24*a* via the side frame 20*c* at a height to form approximately the same plane with the sheet placement face 24*a* of the processing tray 24. Here, both the sheet placement face 24*a* of the processing tray 24 and the manual setting face 29*a* are arranged approximately at the same height position as supporting sheets approximately at horizontal posture. FIG. 12D illustrates a manual-bound state.

As illustrated in FIG. 5, the manual binding position Mp for the manual stapling process with the staple binding unit 26 is arranged on the same straight line as the abovementioned multi-binding positions Ma1, Ma2. Here, there are arranged, on the processing tray 24, the sheet introducing area Ar, the manual-feeding area Fr at the apparatus front side, and a later-mentioned eco-binding area Rr at the apparatus rear side.

[Eco-Binding Position]

The eco-binding position Ep is defined so that a binding process is performed on a corner of sheets as illustrated in FIG. 5. The illustrated eco-binding position Ep is defined at a position where the binding process is performed by the press binding unit 27 on one position at the side edge part in the sheet discharging direction of a sheet bundle. Then, the binding process is performed as being oblique to sheets by a predetermined angle. The eco-binding position Ep is defined in the eco-binding area Rr which is distanced to the apparatus rear side from the sheet introducing area Ar of the processing tray 24.

The side aligning plates 46F, 46R are used to offset-move a sheet bundle aligned at a predetermined position on the processing tray 24 to the eco-binding position Ep. Thus, the side aligning plates 46F, 46R have a function as a sheet bundle offset device to perform offset moving for the eco-binding process. Here, there are two cases as follows as the offset operation to be performed by both the side aligning plates 46F, 46R.

(1) Only the left side aligning plate 46R is moved by a predetermined amount in a direction perpendicular to the sheet discharging direction in a state that the right side aligning plate 46F is retracted to a position being apart from a possible offset position, so as to set a sheet bundle to the eco-binding position Ep.

(2) Both the side aligning plates 46F, 46R are moved by a predetermined amount in a direction perpendicular to the sheet discharging direction in a state of nipping a sheet bundle, so as to set the sheet bundle to the eco-binding position Ep.

The press binding unit 27 is arranged at the eco-binding position Ep and performs eco-binding when a sheet bundle is conveyed to the eco-binding position Ep by the sheet bundle offset device which is structured singularly with the side aligning plate 46R or structured with both the side aligning plates 46F, 46R. Alternatively, it is also possible to adopt a structure that the press binding unit 27 performs eco-binding after being moved to the eco-binding position Ep.

[Mutual Relation Among Respective Binding Positions]

Figure 6:
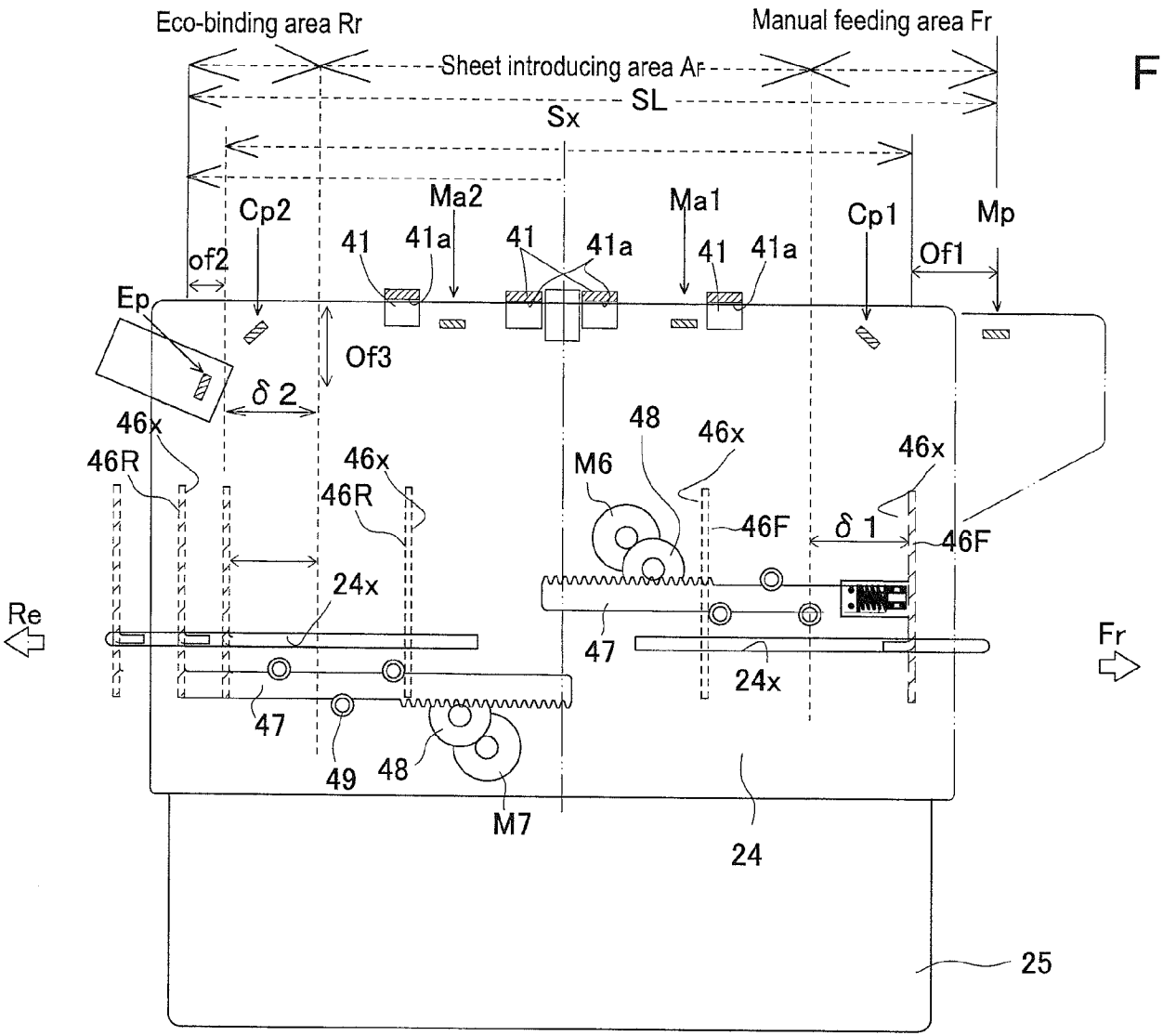
FIG. 6 is a structural explanatory plan view of a side aligning device in the apparatus of FIG. 2.

The multi-binding positions Ma1, Ma2 are defined in the sheet introducing area Ar (at the inside thereof) where sheets are introduced to the processing tray 24 from the sheet discharging port 23. Each of the corner binding positions Cp1, CP2 is defined outside the sheet introducing area Ar at a position which is apart rightward or leftward by a predetermined distance from the sheet center Sx. As illustrated in FIG. 6, at the outer side from a side edge of a maximum size of sheets to be bound, the right corner binding position Cp1 is defined at a position deviated rightward from a sheet side edge by a predetermined amount (δ1) and the left corner binding position Cp2 is defined at a position deviated leftward from a sheet side edge by a predetermined amount (δ2). The deviation amounts are set to be the same (δ1=δ2).

The manual binding position Mp is defined approximately on the same straight line as the multi-binding positions Ma1, Ma2. Further, the corner binding positions Cp1, Cp2 are defined at positions each having an oblique angle (e.g., 45 degrees) to be bilaterally symmetric about the sheet center Sx.

The manual binding position Mp is defined in the manual-feeding area Fr in the apparatus front side Fr and outside the sheet introducing area Ar. The eco-binding position Ep is defined in the eco-binding area Rr at the apparatus rear side Re and outside the sheet introducing area Ar.

Further, the manual binding position Mp is defined at a position which is offset by a predetermined amount Of1 from the right corner binding position Cp1 of the processing tray 24. The eco-binding position Ep is defined at a position which is offset by a predetermined amount Of2 from the left corner binding position Cp2 of the processing tray 24. Thus, the multi-binding positions Ma1, Ma2 are de fined with reference to the sheet center (in center reference Sx), and the corner binding positions Cp1, Cp2 are defined based on the maximum sheet size. Further, the manual binding position Mp is defined at the position which is offset by the predetermined amount Of1 from the right corner binding position Cp1 to the apparatus front side. Similarly, the eco-binding position Ep is defined at the position which is offset by the predetermined amount Of2 from the left corner binding position Cp2 to the apparatus rear side. According to the above, arrangement can be performed in an orderly manner without causing interference of sheet movement.

Next, the sheet movement for the respective binding processes is described. In the multi-binding process, sheets are introduced to the processing tray 24 in center reference and aligned in the above state, and then, the binding process is performed thereon. After the binding process is performed, the sheets are discharged to the downstream side in the above posture. In the corner binding process, sheets are aligned at the alignment position in side reference at a specified side and the binding process is performed thereon. After the binding process is performed, the sheets are discharged to the downstream side in the above posture. In the eco-binding process, sheets introduced onto the processing tray 24 are offset by the predetermined amount Of2 to the apparatus rear side after being stacked into a bundle shape. The binding process is performed thereon after the offset movement. After the binding process, the sheets are returned by a predetermined amount (for example, being the same as or smaller than the offset Of2) to the sheet center side and discharged to the downstream side thereafter.

Further, in the manual binding, an operator sets sheets on the manual setting face 29*a* as being offset by the predetermined amount Of1 from the alignment reference which is positioned at the front side from the processing tray 24. According to the above, a plurality of the binding processes are performed while sheet setting positions therefor are defined in the direction perpendicular to the sheet conveyance direction. Therefore, sheet jamming can be suppressed while keeping high processing speed.

In the eco-binding process, the later-mentioned binding process controller 75 offsets sheets to the eco-binding position Ep being apart from the tailing end reference position by a predetermined amount Of3 in the sheet discharging direction. This is to avoid interference between the staple binding unit 26 for the left corner binding and the later-described press binding unit 27. Here, if the press binding unit 27 is mounted on the apparatus frame 20*a* movably between the binding position and a retracting position retracting therefrom similarly to the staple binding unit 26, sheets are not required to be offset by the amount Of3 in the sheet discharging direction.

Here, the apparatus front side Fr denotes a front side of the external casing 20*b* set by apparatus designing where various kinds of operation are performed by an operator. Normally, a control panel, a mount cover (door) for a sheet cassette, and an open-close cover through which staples are replenished for the staple binding unit 26 are arranged at the apparatus front side. Further, the apparatus rear side Re denotes a side of the apparatus facing to a wall face of a building, for example, when the apparatus is installed (installation conditions; the back face is designed to face a wall).

Thus, in the illustrated apparatus, the manual binding position Mp is defined at the apparatus front side Fr and the eco-binding position Ep is defined at the apparatus rear side Re outside the sheet introducing area Ar with reference thereto. A distance Ofx between the manual binding position Mp and the center of the sheet introducing area Ar which is matched with the sheet center Sx is set larger than a distance Ofy between the eco-binding position Ep and the center of the sheet introducing area Ar (i.e., Ofx>Ofy).

Thus, the manual binding position Mp is defined to be apart from the center of the sheet introducing area Ar with is matched with the sheet center Sx and the eco-binding position Ep is defined to be close to the center of the sheet introducing area Ar. This is because operation of setting a sheet bundle to the manual binding position Mp from the outside is facilitated to be convenient owing to that the manual binding position Mp is apart from the processing tray 24. Further, the eco-binding position Ep is defined to be close to the center of the sheet introducing area Ar. This is because the movement amount when sheets introduced onto the processing tray 24 are offset-moved to the eco-binding position Ep can be small for effectively performing the binding process at increased processing speed.

Next, respective binding processing methods will be described based on FIGS. 7 to 10.

[Moving Mechanism for Staple Binding Unit]

The staple binding unit 26 (first binding processing device) is supported by the apparatus frame 20*a* to be reciprocated by a stapler shifting device with a stroke SL (illustrated in FIG. 6) over the sheet introducing area Ar, the manual feeding area Fr, and the eco-binding area Rr along a sheet end face of the processing tray 24. The structure of the stapler shifting device will be described in the following.

Figure 7:
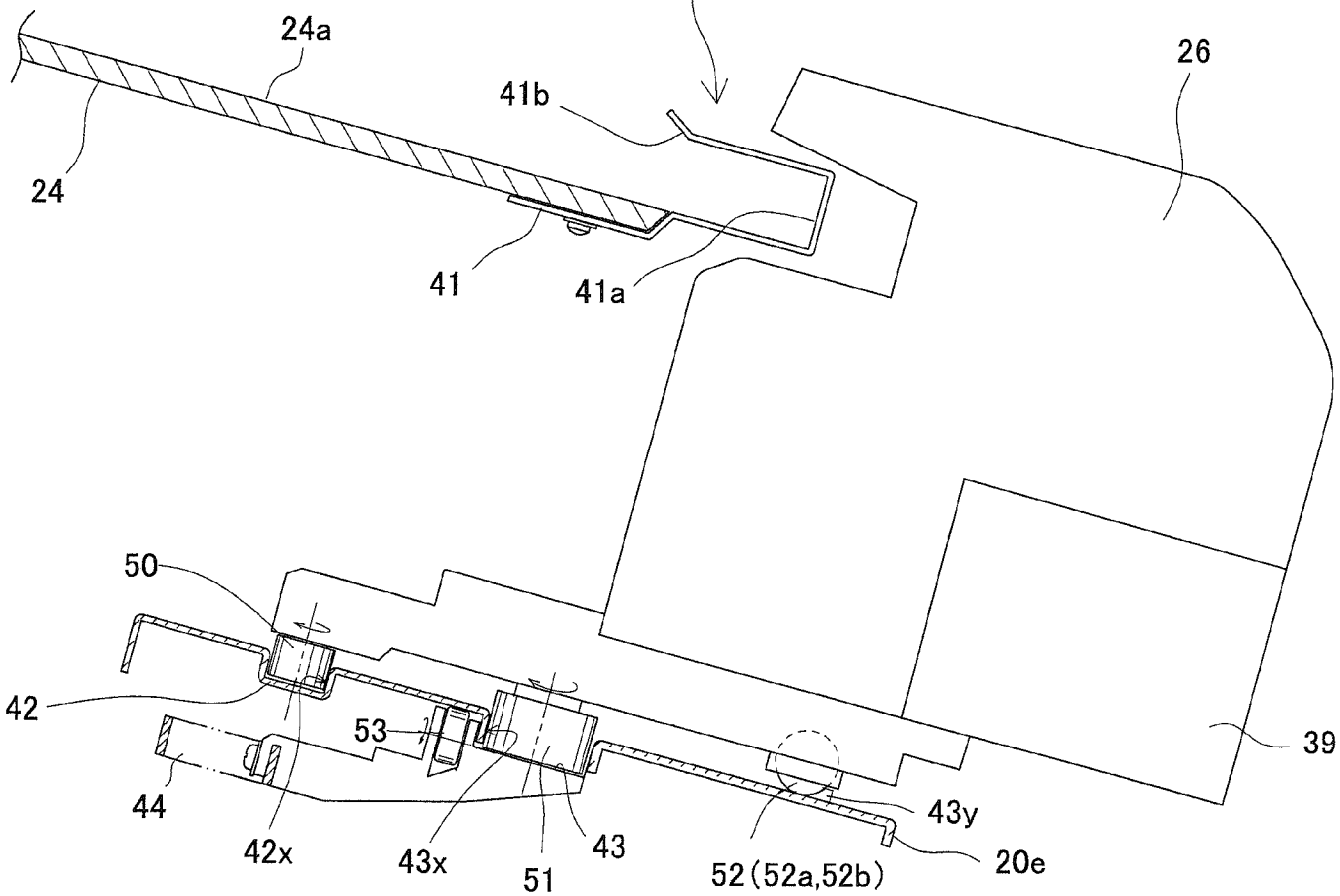
FIG. 7 is an explanatory view of a moving mechanism of a staple binding unit.
Figure 8:
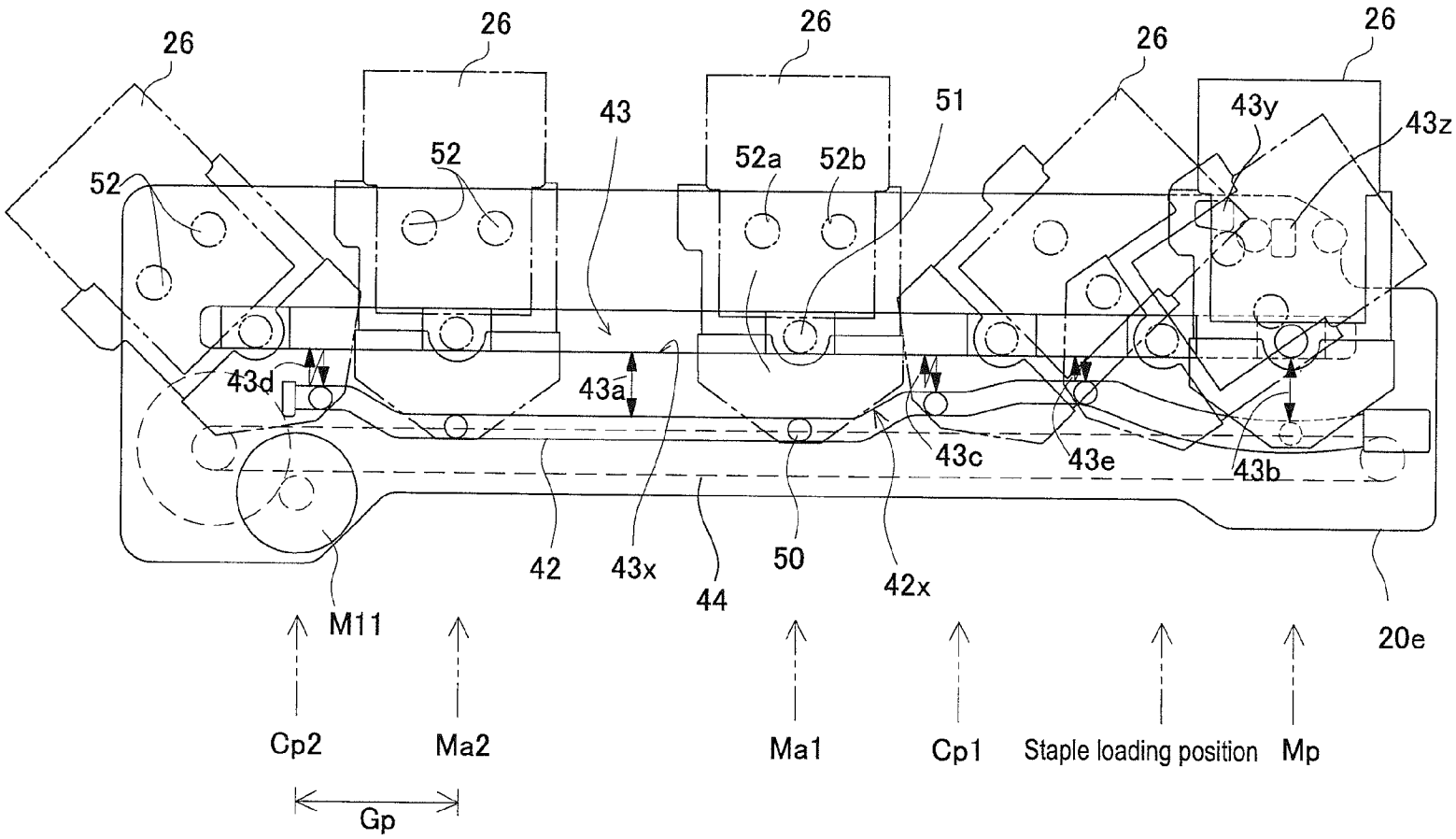
FIG. 8 is an explanatory plan view illustrating binding positions of the staple binding unit.
Figure 9:
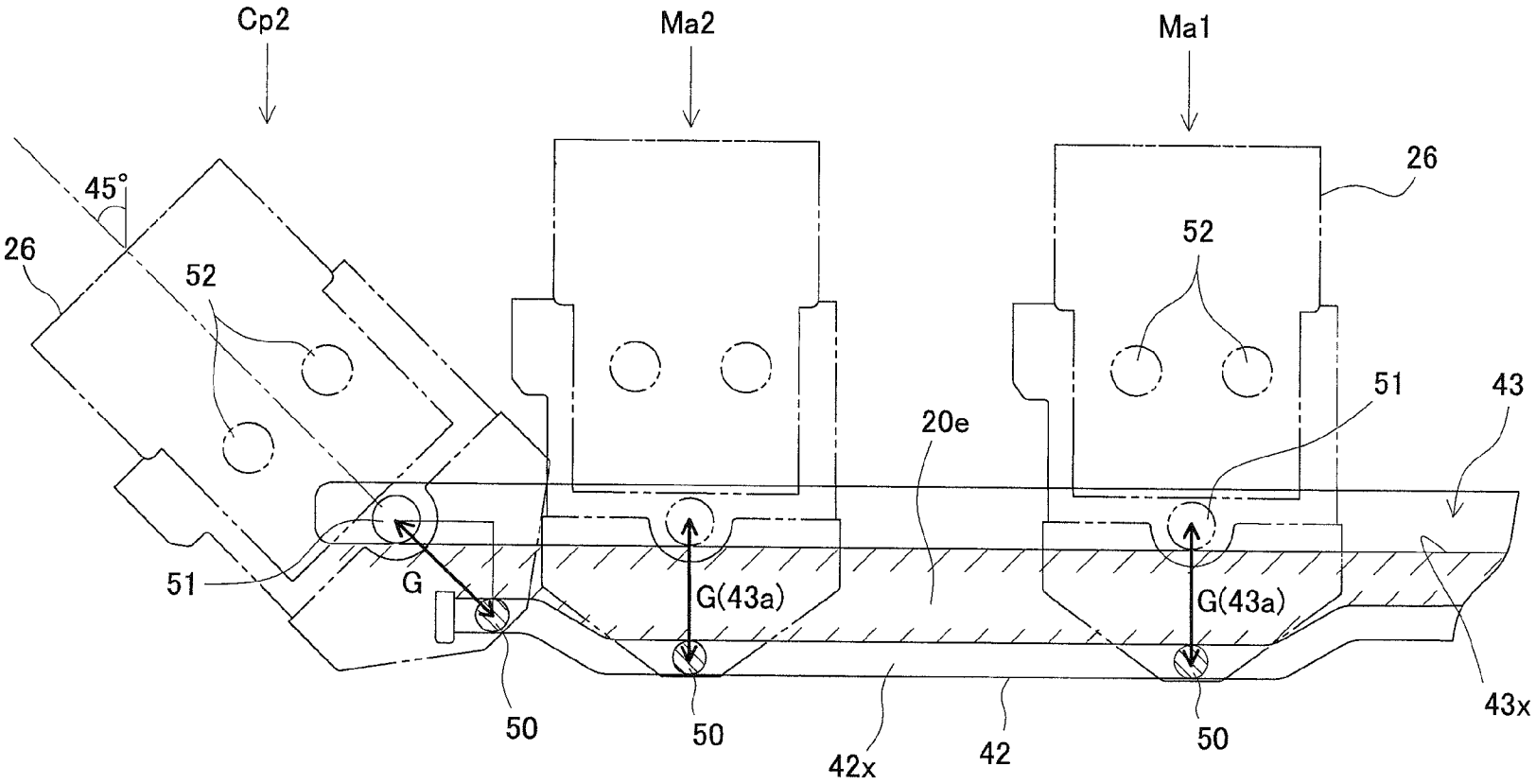
FIG. 9 is an explanatory plan view of multi-binding and left corner binding of the staple binding unit.

FIG. 7 illustrates a front structure that the staple binding unit 26 is attached to the apparatus frame 20*a* and FIG. 8 illustrates a plane structure thereof. FIGS. 9 and 10 illustrate explanatory operational views of the stapler shifting device.

As illustrated in FIG. 7, the stapler shifting device is structured with a travel guide 42 and a slide cam 43 which are arranged at a bottom frame 20*e*. The slide cam 43 is structured with a groove cam to guide a cam follower with a groove. The groove is linearly formed in parallel to the arrangement of the plurality of tailing end regulating members 41 arranged at the processing tray 24. The length of the groove in the longitudinal direction is set to be approximately the same as the stroke SL.

The travel guide 42 is an opening groove formed at the bottom frame 20*e* and an edge of the opening serves as a travel rail face 42*x*. Here, in the longitudinal direction, the travel guide 42 does not have a linear shape but a curved shape. Accordingly, the distance between the travel guide 42 and the slide cam 43 is not constant but variable among three distances being a distance 43*a* (43*b*), a small distance 43*c* (43*d*), and a smaller distance 43*e*.

The staple binding unit 26 is fixed to a travel belt 44 which is connected to a drive motor M11. The drive belt 44 is wound around a pair of pulleys axially-supported by the bottom frame 20*e*. The drive motor M11 is connected to one of the pulleys. Thus, the staple binding unit 26 reciprocates by the stroke SL with forward and reverse rotation of the drive motor M11.

Then, the staple binding unit 26 is engaged with the travel guide 42 and the slide cam 43 as follows. As illustrated in FIG. 7, the staple binding unit 26 is provided with a first rolling roller 50 engaged with the travel rail face 42*x* and a second rolling roller 51 of a cam follower engaged with a travel cam face 43*x* of the slide cam 43. Further, the staple binding unit 26 is provided with a sliding roller 52 (in the drawing, two ball-shaped sliding rollers 52*a*, 52*b*) engaged with a support face of the bottom frame 20*e*.

According to the above structure, the staple binding unit 26 is supported by the bottom frame 20*e* movably via the sliding rollers 52*a*, 52*b* and the guide roller 53. Then, owing to that the first rolling roller 50 is rotated along the travel rail face 42*x* and the second rolling roller 51 is rotated along the travel cam face 43*x*, the staple binding unit 26 is moved along the sheet end face of the processing tray 24.

When the staple binding unit 26 is moved and located at positions corresponding to the multi-binding positions Ma1, Ma2, the distance 43*a* is formed between the first rolling roller 50 and the second rolling roller 51. In this state, since the distance 43*a* is matched with a distance G (FIG. 9) between the first rolling roller 50 and the second rolling roller 51, the staple binding unit 26 is in a posture to be right facing to the sheet end face of the processing tray 24. Accordingly, at the multi-binding positions Ma1, Ma2, the staple binding unit 26 can perform a binding process on a sheet bundle in a state that staples are kept in parallel to the sheet end edge.

When the staple binding unit 26 is at a position corresponding to the left corner binding position Cp2, the distance 43*d* between the first rolling roller 50 and the second rolling roller 51 is smaller than the distance 43*a*. Accordingly, the staple binding unit 26 is swung and kept in a posture as being inclined leftward (for example, by 45 degrees leftward) against the sheet end face. In this case, a staple binding is performed on sheets at the left corner at an angle of 45 degrees. Similarly, when the staple binding unit 26 is at a position corresponding to the right corner binding position Cp1 (FIG. 10A), the staple binding unit is kept in a posture as being inclined rightward (for example, by 45 degrees rightward) and a staple binding is performed on sheets at the right corner at an angle of 45 degrees.

Figure 10B:
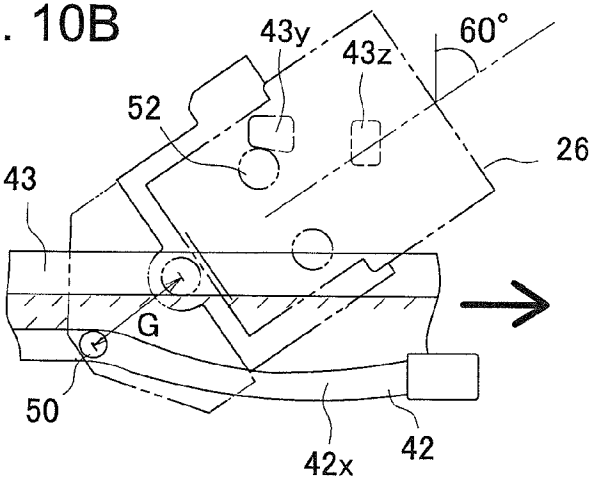
Figure 10C:
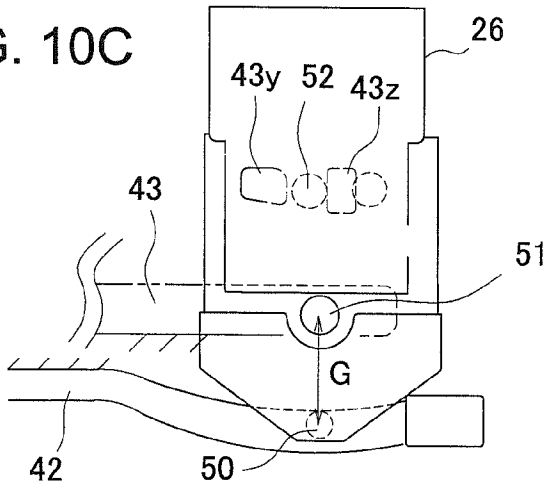
Figure 10A:
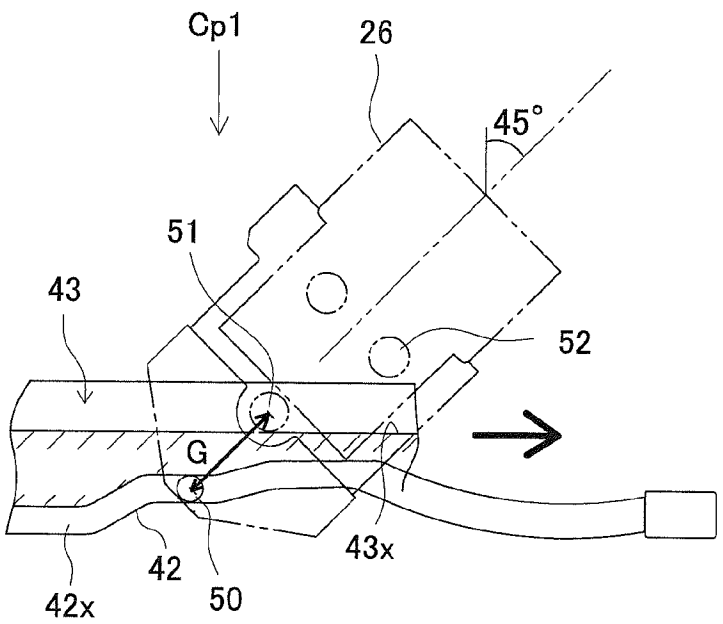

When the staple binding unit 26 is at a position corresponding to the manual binding position Mp, the distance 43*b* is equal to the distance 43*a*. Accordingly, the staple binding unit 26 is in a posture right facing to the sheet end face of the processing tray 24 (FIG. 10C). Then, the staple binding unit 26 can perform a binding process in a state that a staple is kept in parallel to the sheet end edge. Further, when the staple binding unit 26 is at a staple loading position (see FIG. 8), the distance 43*e* is the smallest. Here, the staple binding unit 26 is kept in a posture as being inclined rightward (for example, by 60 degrees) as illustrated in FIG. 10B. The reason why the angular posture of the staple binding unit 26 is varied at the staple loading position is that the posture is matched with an angular direction in which a staple cartridge 39 is mounted thereon. Here, the angle is set in relation with the open-close cover arranged at the external casing 20*b*.

Thus, the angular posture of the staple binding unit 26 against the sheet end face is adjusted in accordance with the distance between the travel guide 42 and the slide cam 43 which are arranged as being mutually opposed. Here, not limited to the opening groove structure, the travel guide 42 may adopt a variety of structures such as a guide rod, a projection rib, and the others. Further, not limited to the groove cam, the slide cam 43 may adopt a variety of shapes as long as having a cam face to guide the staple binding unit 26 in a predetermined stroke direction, such as a projection stripe rib member.

[Staple Binding Unit]

A conventionally-known type is used as the staple binding unit 26. An example thereof will be described based on FIG. 13A. In this example, the staple binding unit 26 is structured as a unit separated from the sheet bundle binding processing unit B. The staple binding unit 26 includes a box-shaped unit frame 26*a*, a drive cam 26*d* swingably axially-supported by the unit frame 26*a*, and a drive motor M8 to rotate the drive cam 26*d*.

The stapling head 26*b* and the anvil member 26*c* are arranged at a binding position as being mutually opposed. The stapling head 26*b* is vertically moved between a waiting position at the upper side and a stapling position at the lower side (the anvil member 26*c*) with the drive cam 26*d* and an urging spring (not illustrated). Further, the staple cartridge 39 is mounted on the unit frame 26*a* in a detachably attachable manner.

Linear blank staples are stored in the staple cartridge 39 and fed to the head portion 26*b* by a staple feeding mechanism. A former member to forma staple into a channel shape by folding both ends thereof and a driver to cause the formed staple to bite into a sheet bundle are built in the head portion 26*b*. With such a structure, the drive cam. 26*d* is rotated by the drive motor M8 and energy is stored in the urging spring. When the rotational angle reaches a predetermined angle, the head portion 26*b* is vigorously lowered toward the anvil member 26*c*. Owing to this action, a staple is caused to bite into a sheet bundle with the driver after being folded into a U-shape. Then, leading ends of the staple are folded by the anvil member 26*c*, so that staple binding is completed.

The staple feeding mechanism is built in between the staple cartridge 39 and the stapling head 26*b*. A sensor (empty sensor) to detect staple absence is arranged at the staple feeding mechanism. Further, a cartridge sensor (not illustrated) to detect whether or not the staple cartridge 39 is inserted is arranged at the unit frame 26*a*.

The staple cartridge 39 adopts a structure that belt-shaped connected staples are stacked as being layered or are stored in a roll-shape in a box-shaped cartridge.

Further, a circuit to control the abovementioned sensors and a circuit board to control the drive motor M8 are arranged at the unit frame 26*a* and transmit an alarm signal when the staple cartridge 39 is not mounted or the staple cartridge 39 is empty. Further, the stapling control circuit controls the drive motor M8 to perform the stapling operation with a staple signal and transmits an operation completion signal when the stapling head 26*b* is moved to an anvil position from the waiting position and returned to the waiting position.

[Press Binding Unit]

A structure of the press binding unit 27 will be described based on FIG. 13(*b*). As a press binding mechanism, there have been known a fold-binding mechanism (see Japanese Patent Laid-open Application No. 2011-256008) to perform binding by forming cutout openings at a binding portion of a plurality of sheets and mating as folding a side of each sheet and a press binding mechanism to perform binding by pressure-bonding a sheet bundle with corrugated faces formed on pressurizing faces 27*b*, 27*c* which are capable of being mutually pressure-contacted and separated.

Figure 13B:
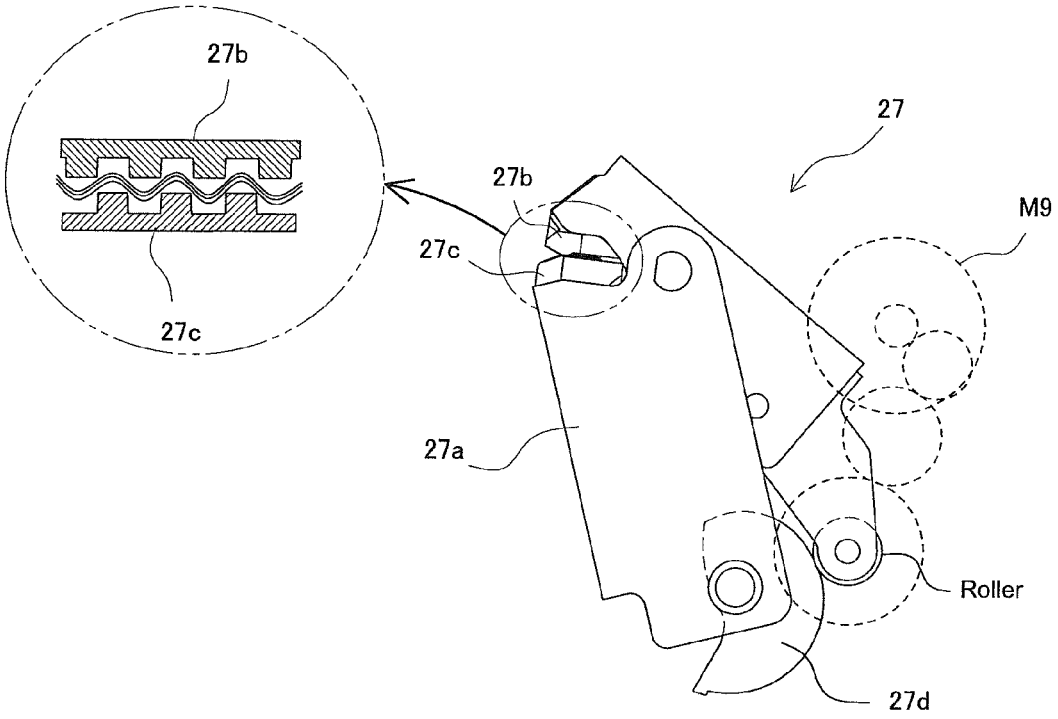
Figure 14:
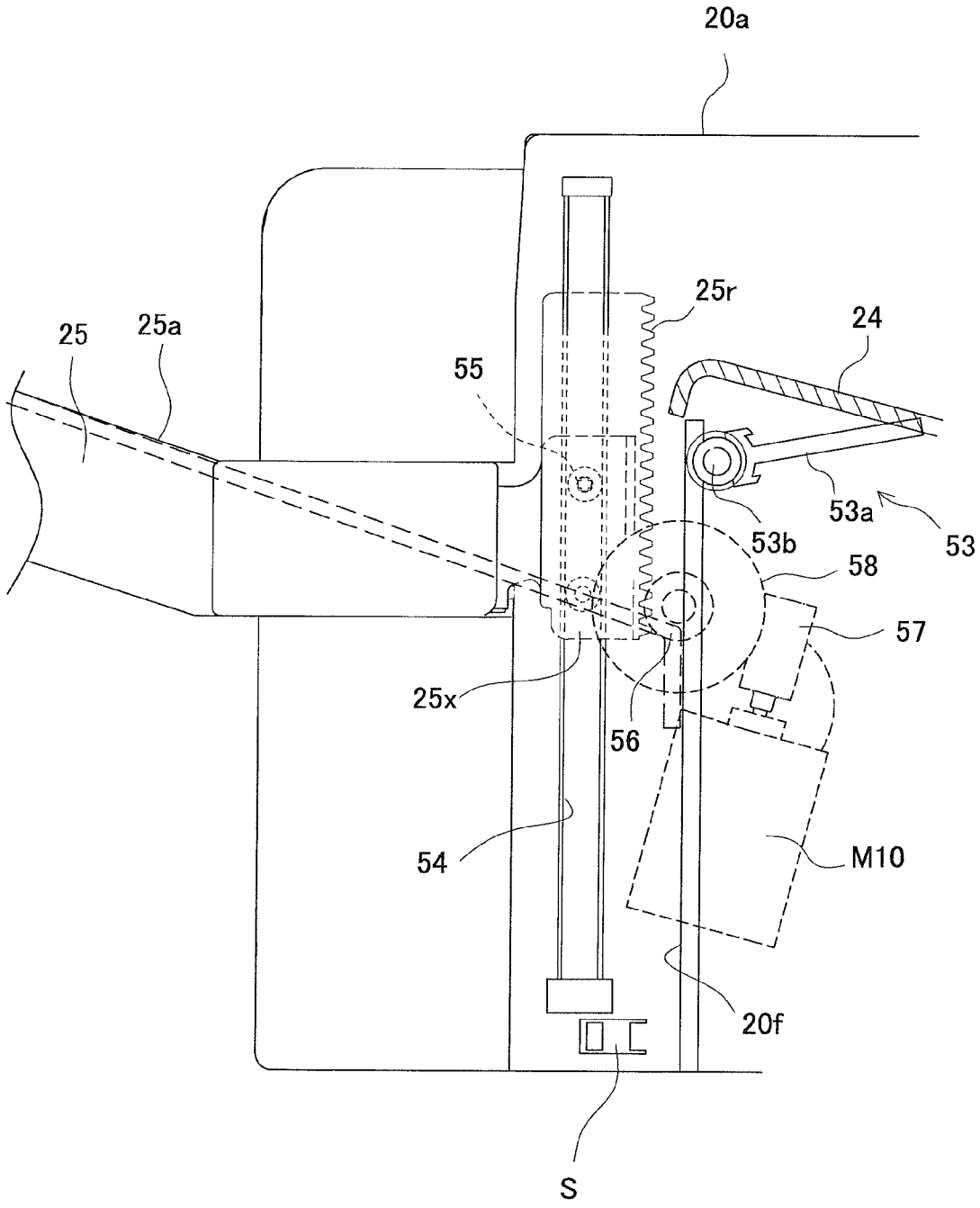
FIG. 14 is a structural explanatory view of the stack tray in the apparatus of FIG. 2.

FIG. 13B illustrates the press binding unit 27. A movable frame member 27*d* is axially-supported swingably by a base frame member 27*a* and both the frames are swung about a support shaft 27*x* as being capable of being mutually pressure-contacted and separated. A follower roller 27*f* is arranged at the movable frame member 27*b* and is engaged with a drive cam 27*e* arranged at the base frame 27*a*.

A drive motor M9 arranged at the base frame member 27*a* is connected to the drive cam 27*e* via a deceleration mechanism. Rotation of the drive motor M9 causes the drive cam 27*e* to be rotated and the movable frame member 27*d* is swung by a cam face (eccentric cam in FIG. 13B) thereof.

The lower pressurizing face 27*c* and the upper pressurizing face 27*b* are arranged respectively at the base frame member 27*a* and the movable frame member 27*d* as being mutually opposed. An urging spring (not illustrated) is arranged between the base frame member 27*a* and the movable frame member 27*d* to urge both the pressurizing faces 27*a*, 27*d* in a direction to be separated.

Figure 12G:
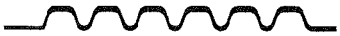

As illustrated in an enlarged view of FIG. 13B, convex stripes are formed on one of the upper pressurizing face 27*b* and the lower pressurizing face 27*c* and concave grooves to be matched therewith are formed on the other thereof. The convex stripes and the concave grooves are formed respectively into rib-shapes as having predetermined length. As illustrated in FIG. 12G, a sheet bundle nipped between the upper pressuring face 27*b* and the lower pressurizing face 27*c* is bound with mutually intimate contact as being deformed into a corrugation shape. A position sensor (not illustrated) is arranged at the base frame member (unit frame) 27*a* and detects whether or not the upper and lower pressurizing faces 27*b*, 27*c* are at the pressurization positions or separated positions. Here, the press binding unit 27 is selectively arranged to be fixed to or to be movable against the apparatus frame 20*a*.

[Sheet Bundle Discharging Device]

Next, the sheet bundle discharging device 60 to discharge a sheet bundle bound by the first binding device 26 or the second binding device 27 to the stack tray 25 will be described based on FIGS. 11A to 11D. The illustrated sheet bundle discharging device 60 includes a first conveying portion 60A and a second conveying portion 60B. Here, conveyance in a first zone Tr1 on the processing tray 24 is performed by the first conveying portion 60A and conveyance in a second zone Tr2 is performed by the second conveying portion 60B, so that relay conveyance is performed. The reason why two kinds of conveying portions are arranged is that the first conveying portion 60A is required to be structured with a less swaying and elongated support member to convey a sheet bundle from a starting position where the sheet end regulating device 40 is arranged toward the stack tray 25 and the second conveying portion 60B is required to be structured as being downsized for travelling on a loop trajectory to drop a sheet bundle to the stack tray 25 as being rotated at a conveying end position.

The first conveying portion 60A is structured with a first discharging member 61 formed of a folded piece whose section has a channel shape, and a sheet face pressing member 62 which presses an upper face of a sheet bundle stopped by a stopper face 61*a* of the first discharging member 61. A Mylar piece formed of an elastic film member is adopted as the sheet face pressing member 62. Owing to that the first conveying portion 60A is formed of a folded piece whose section has a channel shape, when fixed to a later-mentioned carrier member 65A (belt), the first conveying portion 60A can feed the tailing end of the sheet bundle in the conveyance direction as travelling integrally with the belt with less swaying. The first conveying portion 60A reciprocates with a stroke Str1 on an approximately linear trajectory without travelling on a loop trajectory curved as described later.

The second conveying portion 60B is structured with a second discharging member 63 which has a pawl shape. The second discharging member 63 includes a stopper face 63*a* which stops a tailing end face of a sheet bundle, and a sheet face pressing member 64 which presses an upper face of the sheet bundle. The sheet face pressing member 64 having a sheet face pressing face 64*a* is swingably axially-supported by the second discharging member 63. An urging spring 64*b* is arranged to cause the sheet face pressing face to press the upper face of the sheet bundle.

Figure 11A:
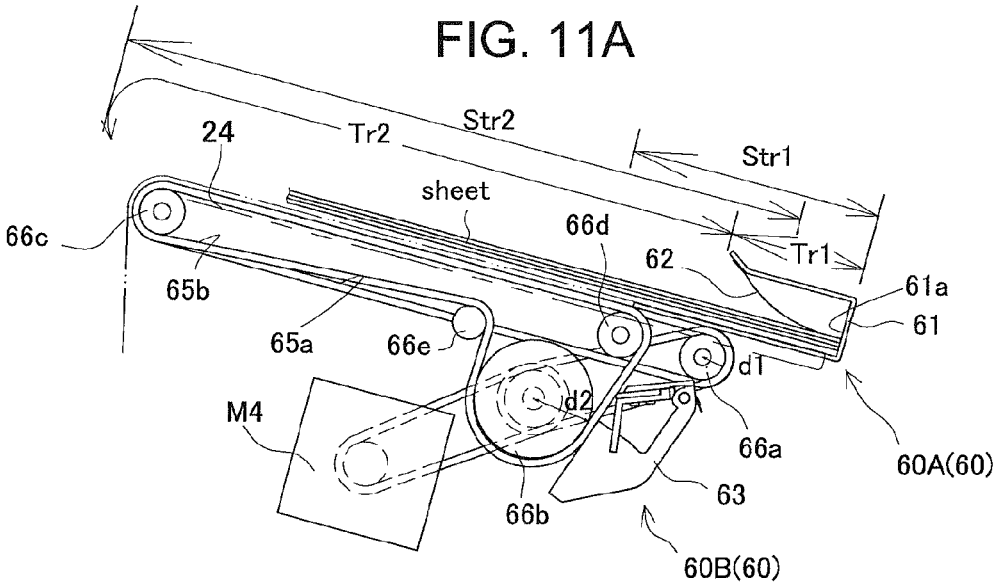
Figure 11B:
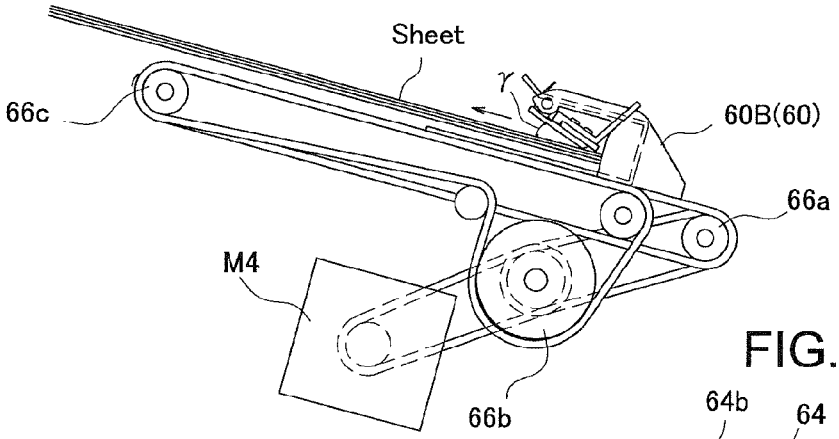
Figure 11C:
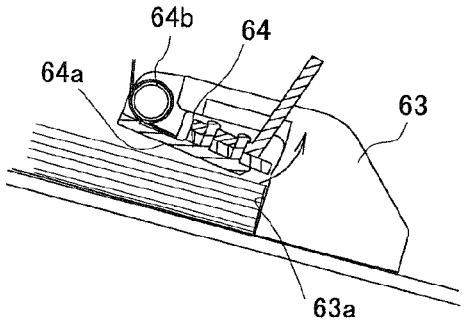
Figure 11D:
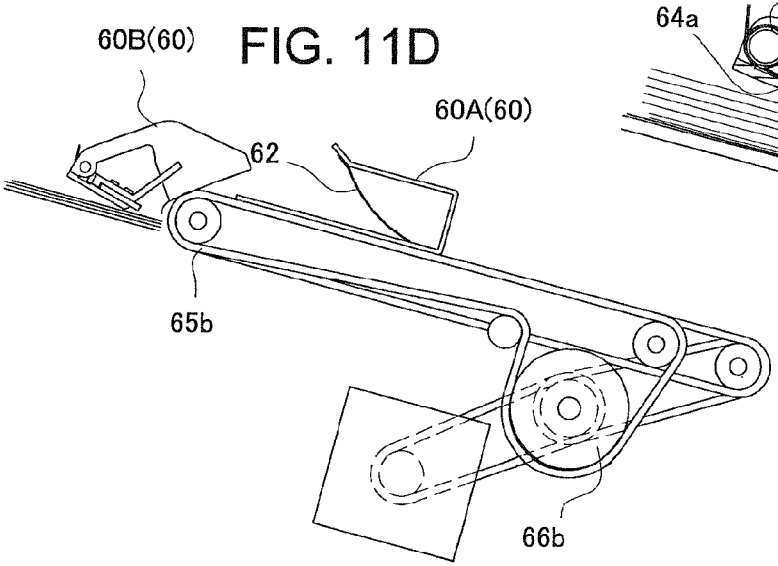

The sheet face pressing face 64*a* is formed as an oblique face oblique to a travelling direction as illustrated and is engaged with the tailing end of the sheet with a setting angle of γ when moved in the arrow direction in FIG. 11B. At that time, the sheet face pressing face 64*a* is deformed upward (counterclockwise in FIG. 11C) in the arrow direction against the urging spring 64*b*. Then, as illustrated in FIG. 10C, the sheet face pressing face 64*a* presses the upper face of the sheet bundle toward the sheet placement face 24*a* side by the action of the urging spring 64*b*.

The first discharging member 61 reciprocate with the first carrier member 65*a* and the second discharging member 63 reciprocate with a second carrier member 65*b* between a base end part and an exit end part of the sheet placement face 24*a*. Driving pulleys 66*a*, 66*b* and a driven pulley 66*c* are arranged at the sheet placement face 24*a* as being mutually distanced by the conveyance stroke. Idling pulleys 66*d*, 66*e* are arranged as illustrated in FIG. 11A.

The first carrier member 65*a* is routed between the driving pulley 66*a* and the driven pulley 66*c*. The second carrier member 65*b* is routed between the driving pulley 66*b* and the driven pulley 66*c* via the idling pulleys 66*d*, 66*e*. Each of the first carrier member 65*a* and the second carrier member 65*b* is preferably formed of a toothed belt. A drive motor M4 is connected commonly to the driving pulleys 66*a*, 66*b*. Here, the diameter of the first driving pulley 66*a* is set smaller than the diameter of the second driving pulley 66*b* so that rotating of the drive motor M4 is transmitted to the first carrier member 65*a* at a low speed and to the second carrier member 65*b* at a high speed.

In addition, a cam mechanism is incorporated in the second driving pulley 66*b* to delay the drive transmission from the motor M4. This is, as described later, because of difference between the movement stroke Str1 of the first conveying portion 60A and the movement stroke Str2 of the second conveying portion 60B and positional adjustment of waiting positions of the respective members.

According to the above structure, the first conveying portion 60A reciprocates on a linear trajectory with the first stroke Str1 from the tailing end regulation position of the processing tray 24. Here, the first zone Tr1 is set within the first stroke Str1. The second conveying portion 60B reciprocates on a semi-loop trajectory with the second stroke Str2 from the first zone Tr1 to the exit end of the processing tray 24. Here, the second zone Tr2 is set within the second stroke Str2.

The first conveying portion 60A is moved from the sheet tailing end regulation position to the downstream side (from FIG. 11A to FIG. 11B) at a speed V1 with rotation in one direction of the drive motor M4 to convey the sheet bundle as pushing the tailing end thereof with the stopper face 61*a*. Being delayed by a predetermined time from the first conveying portion 60A, the second conveying portion 60B projects above the sheet placement face 24*a* from the waiting position (FIG. 11A) at the back face side of the processing tray 24 and is moved at a speed V2 as following the first conveying portion 60A in the same direction. Here, since the speed V2 is set to be higher than the speed V1, the sheet bundle on the processing tray 24 is relayed from the first conveying portion 60A to the second conveying portion 60B.

FIG. 11B illustrates a state of the relay conveyance. The second conveying portion 60B travelling at the speed V2 catches up with the sheet bundle travelling at the speed V1. That is, after passing through the first zone Tr1, the second conveying portion 60B catches up with the first conveying portion 60A and performs conveyance to the downstream side in the second zone Tr2 as being engaged with the tailing end face of the sheet bundle.

When the second conveying portion 60B is abutted, at the relay point at a high speed, to the sheet bundle travelling at the speed V1, the sheet bundle is discharged toward the stack tray 25 while the tailing end of the sheet bundle is held as being nipped between the sheet face pressing member 64 and the carrier member (belt) 65*a* (65*b*) with the upper face of the sheet bundle pressed by the sheet face pressing face 64*a*.

[Paper Guide Mechanism]

There is provided, at the processing tray 24, with a paper guide mechanism 80 for guiding a sheet bundle between the pressurizing faces 27*b*, 27*c* of the press binding unit 27 when the sheet bundle is moved from the alignment position to the binding position Ep with operation of the side aligning plates 46F, 46R as the abovementioned sheet bundle offset device.

Figure 16A:
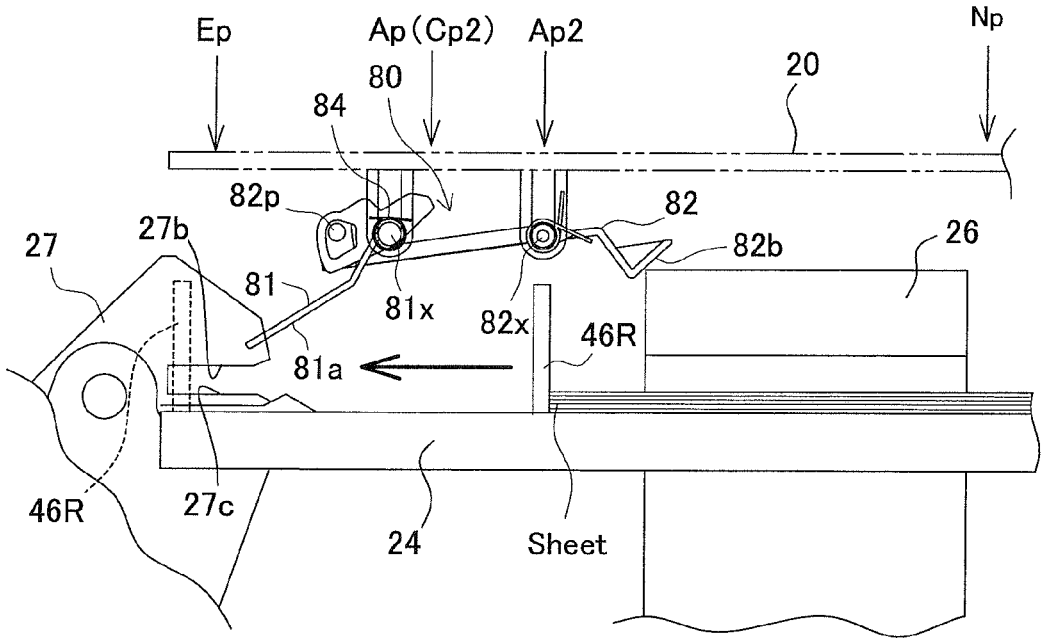
Figure 16B:
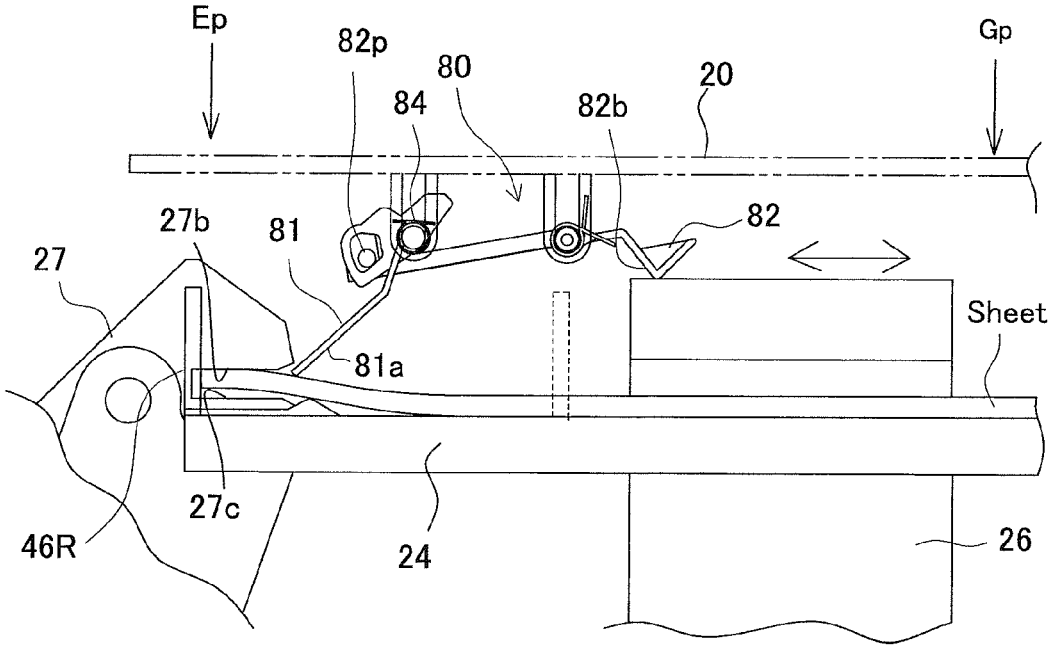

FIG. 16 illustrates the paper guide mechanism 80. A paper guide 81 to guide a sheet bundle from the alignment position Ap3 to the binding position Ep is arranged at the apparatus frame 20*a* above the processing tray 24. The paper guide 81 includes a guide face 81*a* which guides a sheet bundle between a pair of the vertically-opposed pressurizing faces 27*b*, 27*c* of the press binding unit 27.

When sheets are introduced onto the processing tray 24, the paper guide 81 is retracted above the processing tray 24 to avoid interference therewith. When sheets are to be offset-moved toward the binding position after stacked, the guide face 81*a* of the paper guide 81 is arranged to be at a different height position to guide an upper face of the sheets.

The paper guide 81 is supported by the apparatus frame 20*a* swingably about a support shaft 81*x*. An urging spring 84 which urges the guide face 81*a* toward either a high position or a low position is arranged at the axially-supporting portion. Further, a transmission lever 82 is connected to the paper guide 81 with a transmission pin 82*p*. Owing to swing motion of the transmission lever 82, the guide face 81*a* is shifted from a height position of FIG. 16A as being retracted above the processing tray 24 to a low height position of FIG. 16B. Accordingly, an end part 82*b* of the transmission lever 82 is moved to a position to be engaged with the unit frame 26*a* of the staple binding frame 26.

That is, the transmission lever 82 is arranged at the apparatus frame 20*a* swingably with a support shaft 82*x* and another end part of the transmission lever 82 is connected to the paper guide 81 via the transmission pin 82*p*. Further, the other end part 82*b* of the transmission lever 82 is arranged within a movement trajectory of the staple binding unit 26. The later-mentioned binding process controller 75 causes the staple binding unit 26 to move between a previously-set guide position Gp and a retracting position Np. When being at the guide position Gp, the paper guide 81 is in a guiding posture (in a state of FIG. 16B) to be engaged with an upper face of sheets on the processing tray 24. When being at the retracting position Np, the paper guide 81 is at the retracting position (in a state of FIG. 16A) as retracting above the processing tray 24.

Next, description will be performed on a relation between the movement position of the staple binding unit 26 and the retracting position and the guide position of the paper guide 81. In the present embodiment, the alignment position for performing eco-binding process is set at the center of introduced sheets. When sheets are to be introduced, the staple binding unit 26 is moved into a vicinity of a position where engagement with the paper guide 81 is caused and waits at the position until introducing and aligning of the sheets are completed. After introducing of the specified number of sheets and aligning thereof with the aligning device 45 are completed, the staple binding unit 26 is moved from the multi binding position (Ma2) to a position just before the rear side corner binding position Cp2. Here, the other end part 82*b* of the transmission lever 82 is moved from the retracting position of the staple binding unit 26 to the guide position, so that the guide member 81 prepares for shifting of a sheet bundle with the side aligning plates 46F, 46R.

Then, with operation of the sheet bundle offset device, the sheet bundle is moved toward the eco-binding position Ep. At that time, the paper guide 81 guides the sheet upper face between the pressurizing faces 27*b*, 27*c* of the press binding unit 27 in a state of FIG. 16B.

According to the above configuration, rapid response for introducing and aligning of sheets can be obtained with the staple binding unit 26 kept waiting at the multi-binding position during stacking a sheet bundle onto the processing tray 24. After introducing and aligning of the sheets are completed, it is possible to prepare for movement of the sheet bundle with the staple binding unit 26 moved to a position just before the rear side corner. Here, it is also possible that the paper guide 81 is lowered at the rear side corner position (Cp2) to be the guide position. However, since moving to the guide position is performed with the normal rear side corner binding without adopting eco-binding, it is preferable that the paper guide 81 is operated to be lowered at a position to avoid influencing other operations as in the present embodiment, that is, at the position Gp in a range from right after the multi-binding position (Ma2) to right before the rear corner binding position (Cp2).

In the above description, the paper guide 81 is configured to be vertically moved between the retracting position Np and the guide position Gp as being interlocked with movement of the staple binding unit 26. However, it is also possible that the paper guide 81 is interlocked, for example, with a solenoid or the like other than the staple binding unit 26 so as to be vertically moved between the retracting position and the guide position.

[Description of Control Configuration]

Figure 17:
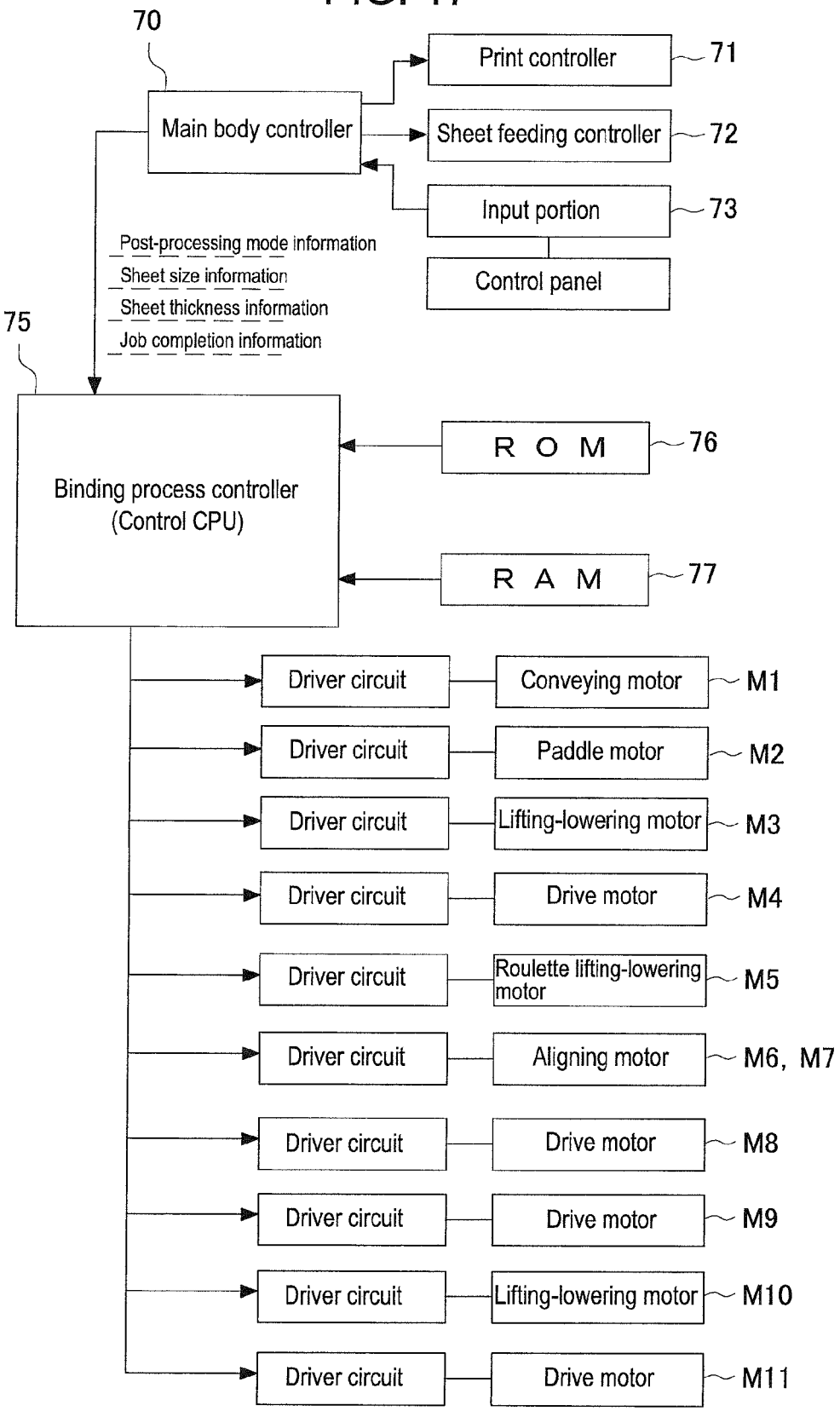
FIG. 17 is an explanatory view of a control configuration of the apparatus of FIG. 1.

As illustrated in FIG. 17, a control configuration of the abovementioned image forming system is divided roughly into a controller (hereinafter, called a main body controller) 70 for the image forming unit A and a binding process controller 75 being controller to control operation of a sheet bundle binding process. Here, the main body controller 70 includes a print controller 71, a sheet feeding controller 72, and an input portion 73.

Setting of an image forming mode and a post-processing mode is input to the input portion 73 via a control panel. Inputting for the image forming mode includes a print mode such as color/monochrome printing and double-face/single-face printing, and image forming conditions such as a sheet size, sheet quality, the number of copies, and enlarged/reduced printing.

Further, inputting for the post-processing mode includes a printout mode, a staple binding processing mode, an eco-binding processing mode, and a jog sorting mode. Further, a manual binding mode which is controlled by the binding process controller 75 separately from the main body controller 70 is included as a processing mode.

Then, in accordance with setting input to the input portion 73, the main body controller 70 transfers, to the binding process controller 75, post-processing mode information, sheet size information, copy number information, thickness information of a sheet on which an image is formed, and the like. Further, the main body controller 70 transfers a job completion signal to the binding process controller 75 each time when image forming is completed.

[Binding Process Controller]

The binding process controller 75 causes the sheet bundle binding processing apparatus to operate in accordance with the post-processing mode set at the main body controller 70. The binding process controller 75 is structured with a control CPU and includes a ROM 76 and a RAM 77. The binding process controller 75 causes a later-mentioned sheet discharging operation to be performed with control programs stored in the ROM 76 and control data stored in the RAM 77. The control CPU 75 is connected to drive circuits for all of the abovementioned drive motors to control starting, stopping, and forward and reverse rotating of the respective motors.

The post-processing mode will be described in the following. In the printout mode, a sheet from the sheet discharging port 23 is stored at the stack tray 25 via the processing tray 24 without a binding process performed. In this case, sheets are overlapped and stacked on the processing tray 24 and a stacked sheet bundle is discharged to the stack tray 25 with a jog completion signal from the main body controller 70.

In the staple binding processing mode, sheets from the sheet discharging port 23 are stacked and collated on the processing tray 24 and the sheet bundle is stored on the stack tray 25 after the binding process is performed thereon. In this case, sheets on which images are to be formed are specified by an operator basically to have the same thickness and size. In the staple binding processing mode, any of the multi-binding, right corner binding, and left corner binding is input via the input portion 73.

In the jog sorting mode, sheets are divided into a group whose sheets having images formed at the image forming unit A are offset and stacked on the processing tray 24 and a group whose sheets are stacked thereon without being offset. An offset sheet bundle and a non-offset sheet bundle are alternately stacked on the stack tray 25. In the illustrated apparatus, an offset area is arranged at the apparatus front side. Then, sheets discharged from the sheet discharging port 23 onto the processing tray 24 in center reference Sx are divided into a group whose sheets are stacked as maintaining the above posture and a group whose sheets are stacked as being offset to the apparatus front side Fr by a predetermined amount.

The reason why the offset area is arranged at the apparatus front side Fr is to maintain an operational area at the apparatus front side Fr for the manual binding process, a replacing process of a staple cartridge, and the like. The offset area is set to have dimensions (in the order of several centimeters) to divide sheet bundles.

[Manual Binding Mode]

When a sensor (not illustrated) detects setting of a sheet bundle to the manual setting face 29*a*, the binding process controller 75 causes the staple binding unit 26 to move to the manual binding position. Subsequently, when an operation switch (not illustrated) is depressed by an operator, the binding process is performed. When a binding mode other than the manual binding mode is instructed by the main body controller 70 in a state that a sheet bundle is set at the manual setting face 29*a*, the binding process controller 75 is configured to provide priority to any one of the above.

[Description of Post-Processing Operation]

In the following, operational states of the respective binding processes will be described with reference to flowcharts in FIGS. 18 to 22. In the flowcharts, "a paddle" denotes a sheet introducing device (paddle rotor 36 or the like), "a roulette" denotes a raking rotor 33, "aligning plates" denote side aligning plates 46F, 46R, "assists" denote the first and second conveying portions 60A, 60B, "a button" denotes an operation switch of a stapling device, and "an LED" denotes an indication lamp indicating that a stapling operation is running, respectively.

[Aligning Operation]

Figure 18:
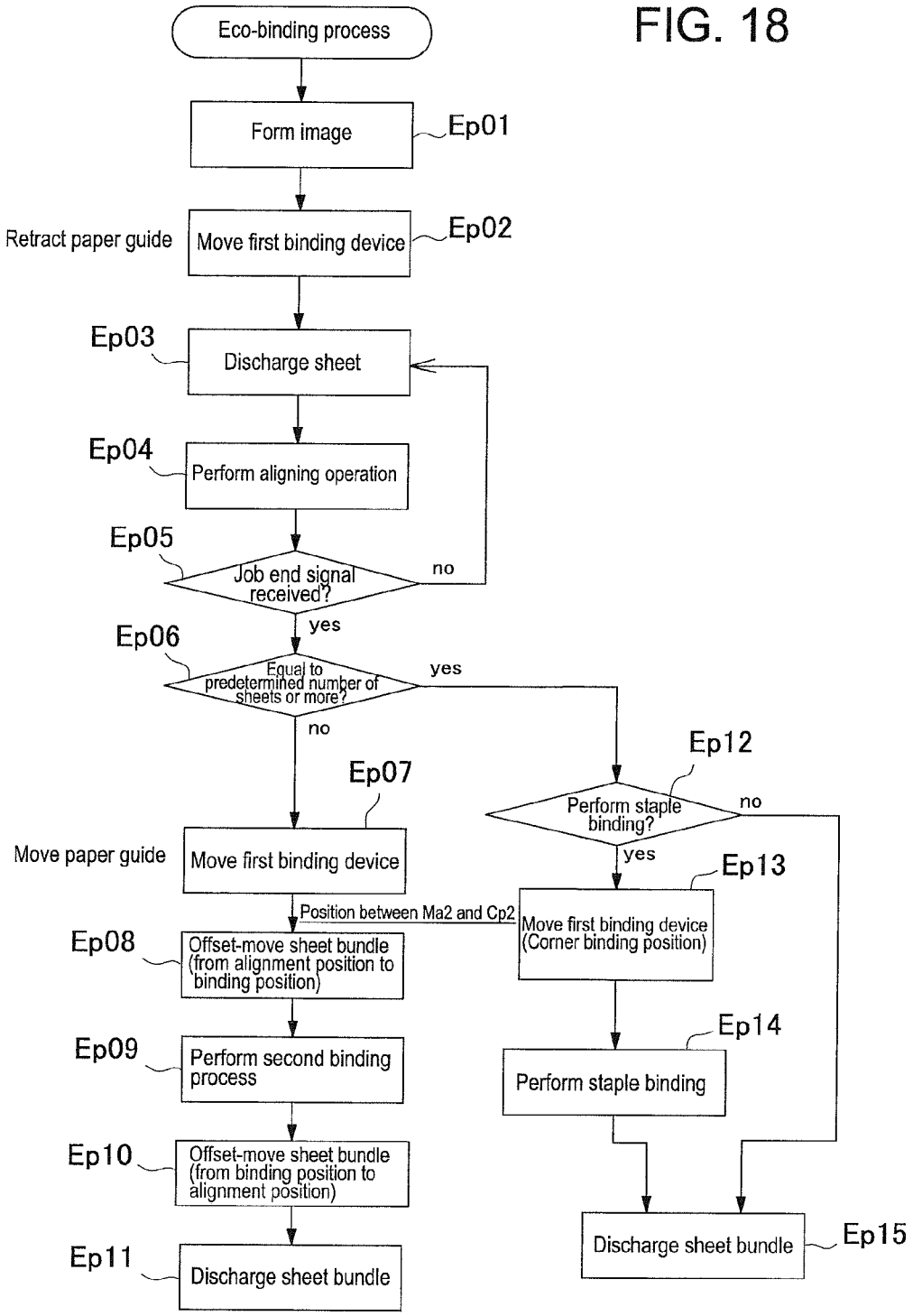
FIG. 18 is a flowchart of sheet bundle aligning operation in an eco-binding mode according to the present invention.

Next, a sheet bundle aligning operation in the abovementioned eco-binding mode will be described. As illustrated in FIG. 18, mode setting is performed at the image forming unit A (Ep01). When the eco-binding processing mode is set, the binding process controller 75 causes the first binding device (staple binding unit) 26 to move to the waiting position (Np position) (Ep02). The waiting position Np is set to a position to cause the paper guide mechanism 80 to be in a retracting posture (above the processing tray 24).

Next, the binding process controller 75 causes a sheet to be introduced from the sheet discharging path 22 to the processing tray 24 (Ep03). Then, the binding process controller 75 causes the side aligning plates 46F, 46R to perform an aligning operation (Ep04). Sheets are stacked into a bundle shape on the processing tray 24 by repeating the above operations. When the binding process controller 75 receives a job end signal (Ep05), the binding process controller 75 determines whether or not the number of sheets is equal to or larger than a predetermined number (Ep06).

When the number of sheets is smaller than the predetermined number, the binding process controller 75 causes the first binding device 26 to move from a previously-set waiting position Np to the guide position Gp (Ep07). According to the above, the paper guide 81 is displaced from the retracting position above the processing tray 24 into a guide posture to be engaged with an upper face of sheets on the processing tray 24.

Then, the binding process controller 75 causes the sheet bundle offset device (side aligning plates 46F, 46R) to move the sheet bundle from the alignment position Ap3 to the eco-binding position Ep (Ep08). An amount of the movement is previously set as Of2. Here, the eco-binding position Ep is set at the outer side of a maximum size sheet (maximum sheet for eco-binding) to be introduced onto the processing tray 24, that is, outside the introducing area.

Next, the binding process controller 75 causes the press binding unit 27 to operate to perform the eco-binding process (Ep09). As described above, in this operation, the drive motor M9 arranged at the press binding unit 27 is activated and the upper and lower pressurizing faces 27*b*, 27*c* are pressure-contacted via the drive cam 27*e*.

Subsequently, when an operation completion signal is received from the press binding unit 27, the binding process controller 75 causes the sheet bundle offset device (side aligning plates 46F, 46R) to re-operate to offset the sheet bundle by a predetermined amount from the eco-binding position Ep toward the sheet center (Ep10). The offset position is previously set at a position suitable for discharging the sheet bundle to the stack tray 25 at the downstream side. Then, the binding process controller 75 causes the sheet bundle discharging device 60 to operate to discharge the sheet bundle to the stack tray 25 at the downstream side (Ep11).

By the way, when the number of sheets on the processing tray 24 is equal to or larger than the predetermined number in step Ep06, following operations are performed. The binding process controller 75 waits for a signal of operator's selection whether or not staple binding is to be performed, for example, with displaying on the control panel (Ep12).

When a staple binding process is instructed, the binding process controller 75 causes the staple binding unit 26 to move to be positioned at the corner binding position (Ep13) and to perform a stapling operation (Ep14). Subsequently, the sheet bundle is discharged toward the stack tray 25 at the downstream side (Ep15).

When the instruction in step Ep12 is not to perform staple binding, the sheet bundle on the processing tray 24 is discharged toward the stack tray 25 at the downstream side (Ep15).

[Staple Processing Mode]

Figure 19:
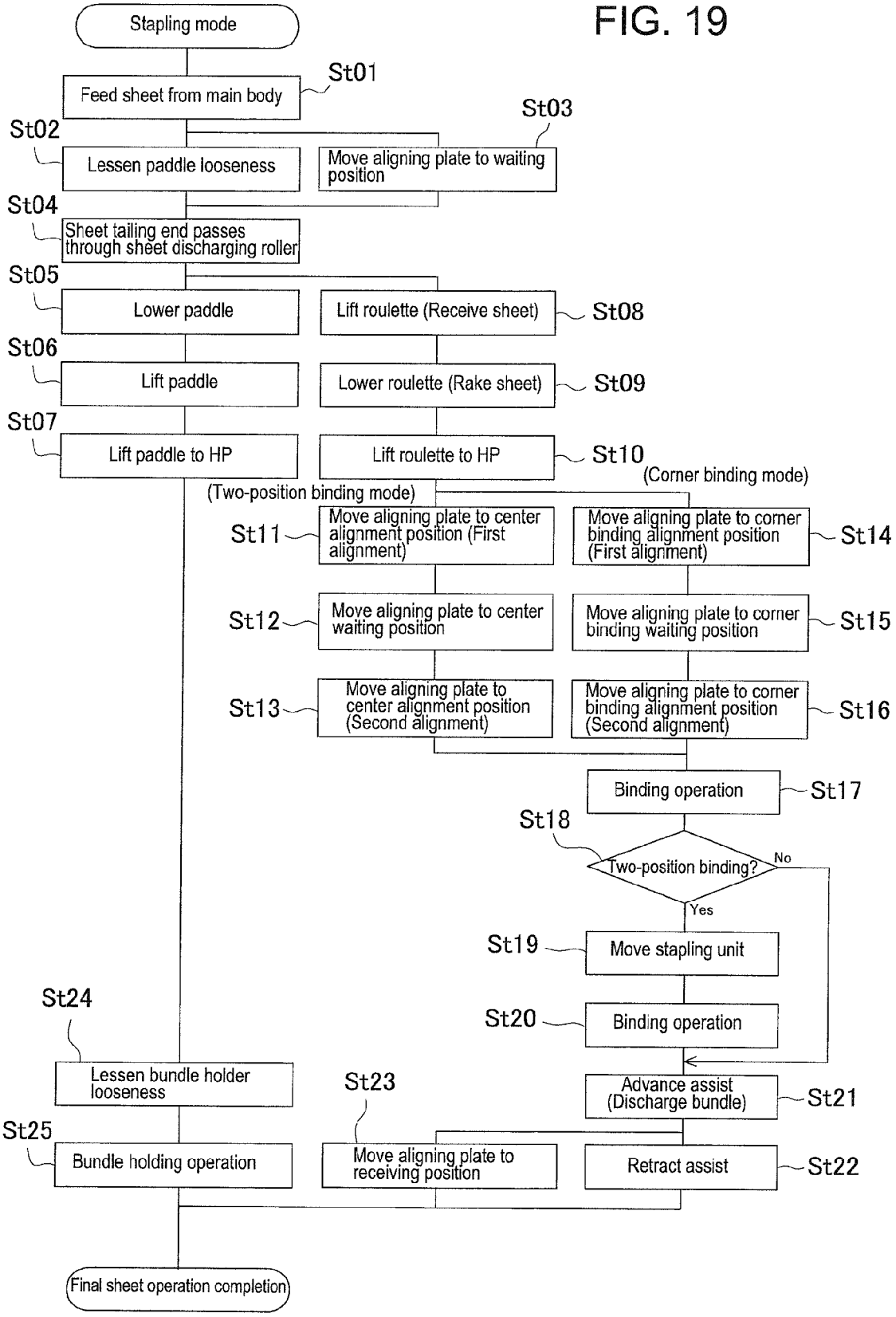
FIG. 19 is an operational flowchart of a staple binding processing mode.
Figure 20:
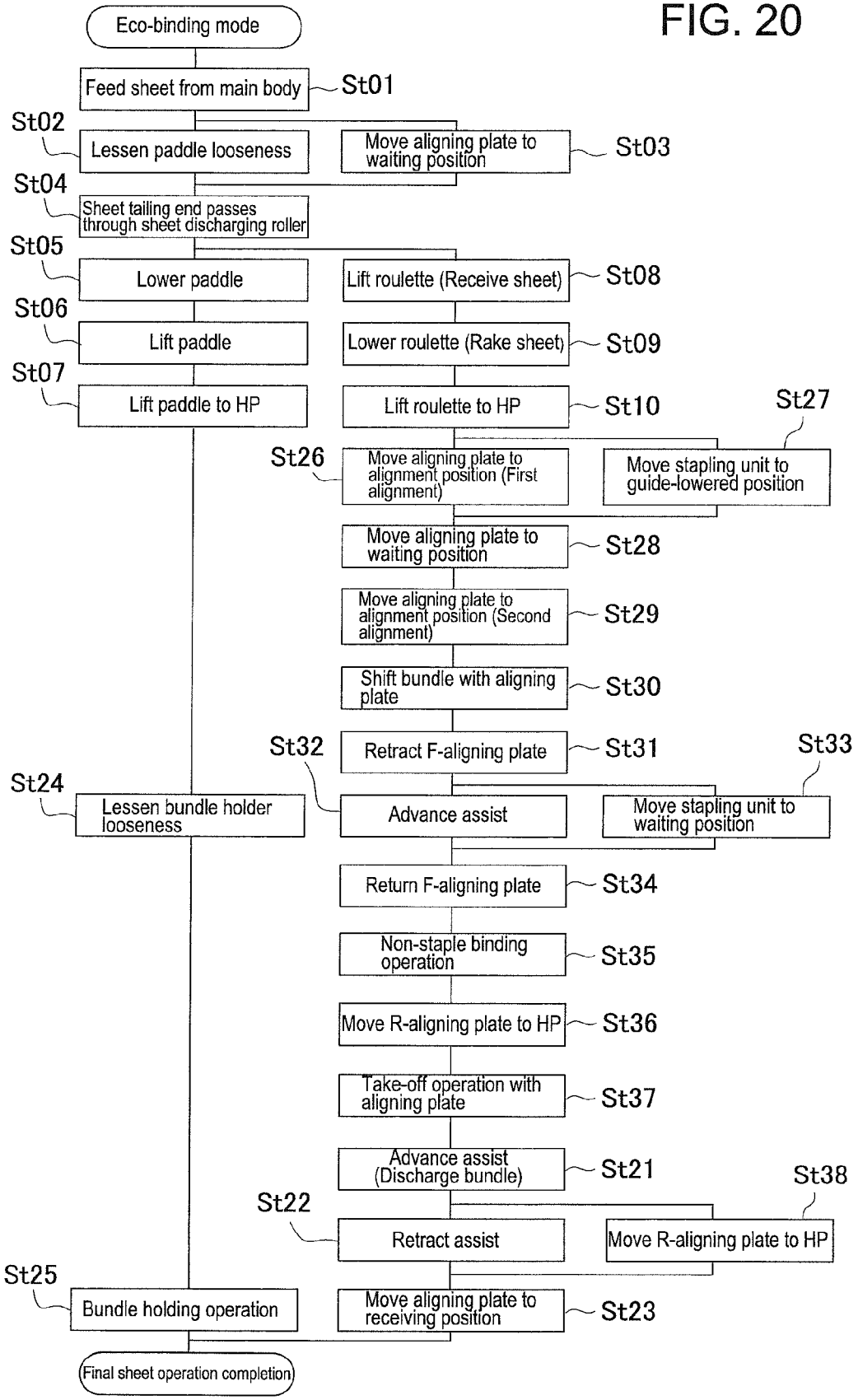
FIG. 20 is an operational flowchart of the eco-binding mode.

In FIG. 19, an image is formed on a final sheet for image forming and the final sheet is discharged from an image forming unit main body at the upper side (St01). At that time, the abovementioned job end signal is transmitted from the image forming unit and the binding process controller 75 causes the paddle rotor 36 to position and wait at a predetermined position (waiting of paddle vanes) (St02). At the same time, the right-left aligning plates 46F, 46R are moved to waiting positions (St03). A sheet fed from the sheet discharging port 16 of the image forming unit A is introduced from the introducing port 21 of the sheet introducing path (sheet discharging path) 22. Then, discharging of the sheet tailing end by the sheet discharging roller 32 is detected by the sheet sensor Se1 (St04).

The binding process controller 75 lowers the paddle rotor 36 waiting on the processing tray 24 at the time when the sheet tailing end is separated from the sheet discharging roller 32 (St05). This operation is performed by activating the paddle lifting-lowering motor M3. Concurrently with the paddle lowering operation, the binding process controller 75 lifts the roulette 33 to be retracted above the upmost sheet on the processing tray 24 (St08).

With the above operation, the sheet fed from the image forming unit A is fed to the sheet introducing path 22, and after the sheet tailing end passes through the sheet discharging roller 32, the sheet is reversely conveyed by rotating the paddle rotor 36 in the direction opposite to the sheet discharging direction in a state that the roulette 33 is retracted above the processing tray 24. Thus, the sheet fed to the sheet introducing path 22 is stored on the processing tray 24 below the sheet discharging port 23 with the conveying direction thereof reversed at the sheet discharging port 23.

Next, the binding process controller 75 lifts the paddle rotor 36 to be retracted from the sheet when a predetermined time passes after the sheet is reversely conveyed from the sheet discharging port 23 in the direction opposite to the sheet discharging direction (St06). Concurrently with the above, the roulette 33 rotating in the direction opposite to the sheet discharging direction is lowered from the waiting position and engaged with the sheet introduced onto the processing tray 24 (St09).

According to the above operation, the sheet is fed from the sheet discharging port 23 by the sheet discharging roller 32 and introduced onto the processing tray 24 as being reversely conveyed from the sheet discharging port 23 by the paddle rotor 36 in the direction opposite to the sheet discharging direction. Then, the sheet is fed toward a predetermined position (toward the tailing end regulating member 41) of the processing tray 24 by the roulette 33.

In the above sheet discharging operation, sheets having different sizes are discharged from the sheet discharging port 23 in center reference Sx. It is also possible to perform discharging from the sheet discharging port 23 in side reference. Here, for convenience, description is performed on a case of discharging in center reference Sx.

Next, the binding process controller 75 moves the paddle rotor 36 to a home position (HP) at the time when the tailing end of the sheet introduced onto the processing tray 24 is assumed to be abutted to the tailing end regulating stopper (tailing end regulating member) 41 with reference to a detection signal of the sheet discharging sensor Set (St07). Similarly, the roulette 33 is moved to a home position HP (St10).

Next, the binding process controller 75 causes the aligning device 45 to bias and align the sheet in a state that the tailing end thereof is abutted to the tailing end regulating member 41. The aligning operation differentiates sheet alignment positions between a case that the multi-binding mode is specified and a case that the corner binding mode is specified. When the multi-binding mode is specified, the binding process controller 75 causes the right-left side aligning members 46F, 46R to reciprocate (center alignment) between alignment positions where the sheet introduced onto the processing tray 24 is matched with a size width in center reference (center reference Sx in the drawing) and waiting positions separated outward therefrom. That is, the binding process controller 75 biases and aligns the sheet by causing the side aligning plates 46F, 46R to move from the waiting positions being wider than the size width to the alignment positions being matched with the size width based on size information sent from the image forming unit A (St11 to St13).

When the corner binding mode is specified, the binding process controller 75 causes one of the right-left side aligning plates 46F, 46R at a binding position side to move to and stop at the binding position based on size information and to move the other thereof to move to an alignment position from a waiting position retracting therefrom based on the size width of the sheet introduced to the processing tray 24. The alignment position (of the aligning plate at the movable side) is set to have a distance against the alignment position (of the aligning plate at the binding position side) to be matched with the size width (corner binding position alignment). That is, in the corner binding process, in accordance with the right corner binding process or the left corner binding process, one of the side aligning plates 46F, 46R is moved and kept stopped, and then, the other thereof is moved by an amount being matched to the size width after the sheet is introduced to the processing tray 24 to perform aligning (in side reference) (St14 to St16).

Next, the binding process controller 75 performs the binding operation (St17). In the multi-binding, the staple binding unit 26 previously staying at the binding position is activated to perform the binding process thereat, and then, the binding process is performed at the second binding position after the staple binding unit 26 is moved by a predetermined distance along the sheet tailing end edge (St18 to St20). In the corner binding, in accordance with right corner binding process or the left corner binding process, the staple binding unit 26 stopped at either the right corner binding position Cp1 or the left corner binding position Cp2 is activated and the binding process is performed thereat.

Next, when an operation completion signal is received from the staple binding unit 26, the binding process controller 75 causes the sheet bundle discharging device 60 to operate to discharge the sheet bundle from the processing tray 24 toward the stack tray 25 at the downstream side (St21). When the sheet bundle discharging operation is completed, the binding process controller 75 moves the sheet bundle discharging device 60 to return to the initial position (St22). Concurrently with the above, the aligning device 46 is moved to return to the initial position (the waiting position to introduce a sheet to the processing tray 24) (St23).

Further, the binding process controller 75 causes the drive motor (in the drawing, the drive motor M2 commonly used for the paddle rotor 36) to rotate the bundle holding device (elastic holding member) 53 arranged on the stack tray 25 (St24), so that the upmost sheet of the sheet bundle introduced to the stack tray 25 is pressed and held (St25).

As described above, in the multi-binding mode of the staple processing mode, the binding process controller 75 performs positional aligning, in center reference, of sheets having different sizes in the direction perpendicular to the sheet discharging direction. Accordingly, a thick sheet bundle having a number of stacked sheets can be aligned at an accurate position. Further, the binding process controller 75 performs aligning in side reference having a sheet side edge as the reference in the corner binding mode, and performs aligning in center reference having the sheet center as the reference in the multi-binding mode. Here, since a binding process is performed in a state of being stopped at each alignment position, the binding process can be performed on a thick sheet bundle having a relatively large stacking amount.

[Eco-Binding Mode]

In the eco-binding operation, the binding process controller 75 performs the operation from step St1 to step St10 in which the sheet introduced onto the processing tray 24 is positioned as being abutted to the tailing end regulating member 41 as being similar to the abovementioned operation. Here, description of the above is skipped with the same reference provided.

When the process in step St10 is completed, before sheets are introduced onto the processing tray 24, the binding process controller 75 causes the side aligning plate 46R located at the binding unit side to move to an alignment position Ap4 being close to the eco-binding position Ep and to wait in a state of staying thereat (St26). Concurrently with this operation, the binding process controller 75 causes the paper guide 81 to move from a retracting position above the processing tray 24 to an operating position on the processing tray 24 (St27). In the drawing, the height shifting of the paper guide 81 is performed so that the height position of a guide face is moved from the retracting position being a high position to the operating position being a low position as being synchronized with movement of the staple binding unit 26. That is, the binding process controller 75 causes the staple binding unit 26 to move from a predetermined position (home position) to a position to be engaged with the sheet bundle guide. In the present embodiment, the staple binding unit 26 is arranged to be engaged with the paper guide 81 when located at a position Gp in FIG. 5 between Ma2 (the left multi-binding position) and Cp1 (the left corner binding position). In step St27 being the same as in step Ep07, the binding process controller 75 causes the staple binding unit 26 to move from the previously-set waiting position Np to the guide position Gp. According to the above, the paper guide 81 is displaced from the retracting position above the processing tray 24 into a guide posture to be engaged with an upper face of sheets on the processing tray 24.

Subsequently, the binding process controller 75 causes the right side aligning plate 46F at the opposite side to move to a waiting position distanced from a side edge of the sheet introduced onto the processing tray 24 (St28), and then, causes the right side aligning plate 46F to move to an alignment position as driving the aligning motor (St29). Accordingly, the sheets on the processing tray 24 are aligned. The alignment position is set to a position so that a distance against the left side aligning plate 46R staying at the eco-binding alignment position is matched with the sheet width size.

Figures 15A, 15B, 15C, 15D, 15E, 15F:
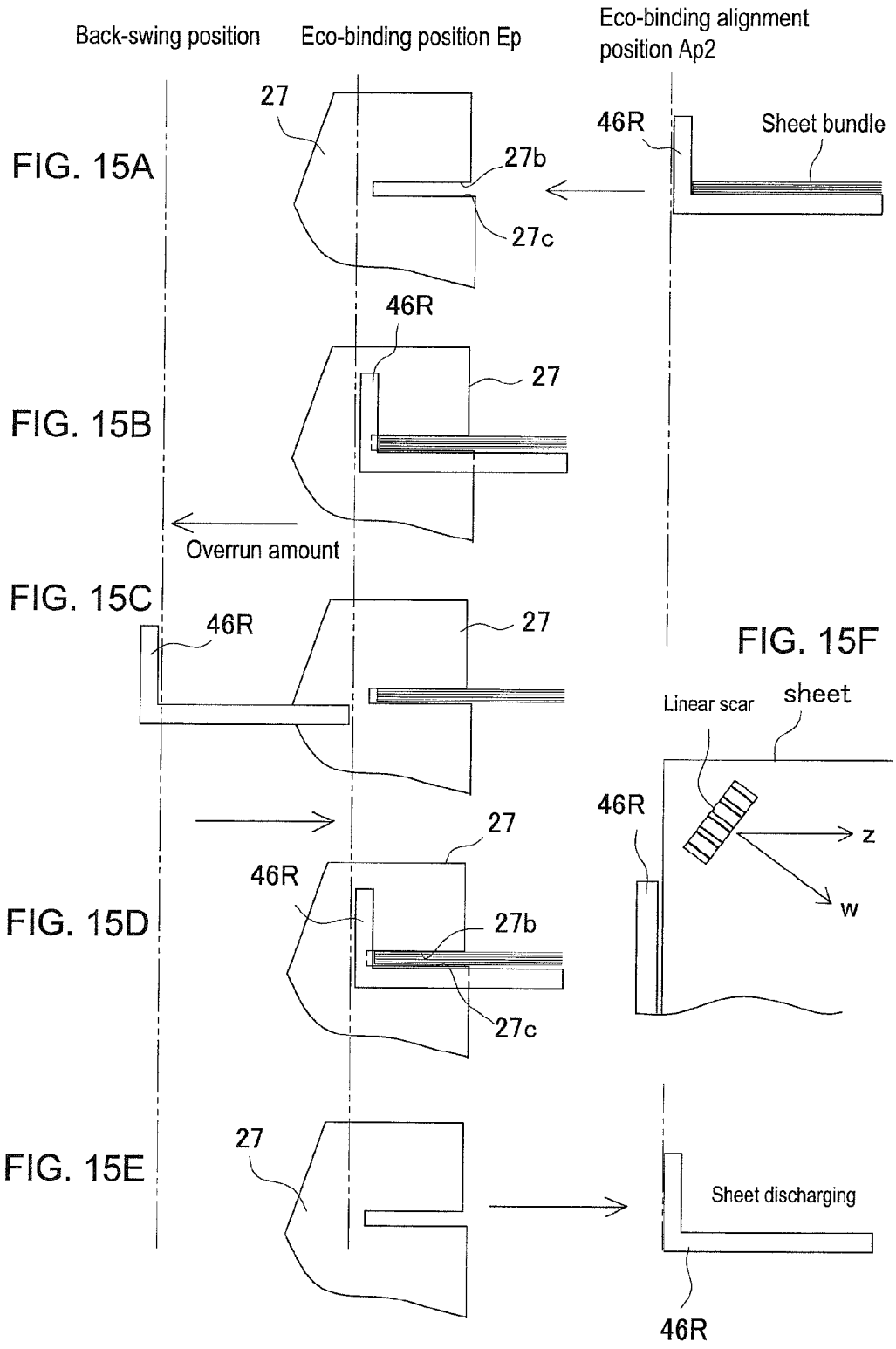

As illustrated in FIG. 15A, in eco-binding, aligning is performed at the eco-binding alignment position being apart from the eco-binding position Ep. If the alignment position of the above is set at a position being close to the eco-binding position Ep, there may be a case that sheet jamming is caused during aligning by interference of sheets with the eco-binding unit 27. In the present embodiment, such a problem is prevented by setting the alignment position at the same position as the alignment position Ap2 when the R-corner binding process is performed by the staple binding unit 26. By the way, it is also possible that the eco-binding alignment position is set at the alignment position Ap3 in center reference when the multi-binding process is performed. However, in this case, consideration is needed on that processing takes time owing to required time for moving a sheet bundle to the eco-binding position Ep. Accordingly, not limited to the alignment position Ap2, the eco-binding alignment position is preferably set at a position being close to the eco-binding position Ep to the extent possible within a range where interference between sheets and the eco-binding unit 27 is not caused.

Figure 25A:
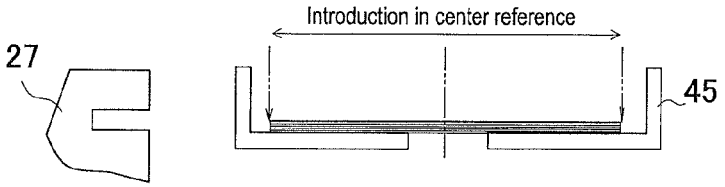
FIGS. 25A to 25I are explanatory views schematically illustrating aligning states of sheets in the eco-binding mode.
Figure 25B:
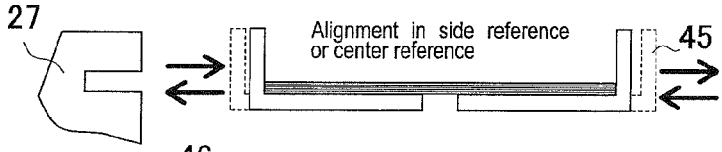

FIGS. 25A to 25I schematically illustrate sheet aligning states in the eco-binding mode. FIG. 25A illustrates a state that sheets are introduced from the sheet discharging path 22 onto the processing tray 24. Sheets are introduced in center reference from the sheet discharging path 22 onto the processing tray 24 while the aligning device 45 is kept waiting at a position being apart outward from the maximum sheet size. FIG. 25B illustrates a state of aligning the sheets. The right-left pair of aligning devices 45 perform positional aligning of sheets in center reference or side reference. Here, whether the aligning is performed in center reference or side reference is previously determined at a designing stage and incorporated in software.

Figure 25C:
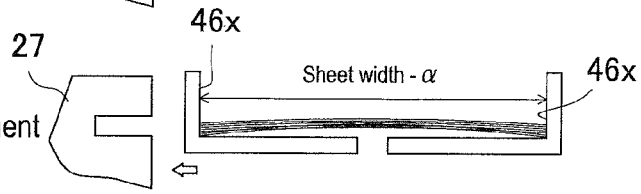

Next, as illustrated in FIG. 25C, the binding process controller 75 causes the side aligning plates 46 to offset-move the sheet bundle aligned at the eco-binding alignment position Ap2 to the eco-binding position Ep (St30). Then, the side aligning plate 46F located at the apparatus front side is retracted into a state of being apart from the sheets by a predetermined amount (St31). At that time, the distance between the right-left pair of aligning devices 45 is set to be smaller than the sheet width (sheet width $-\alpha$). Accordingly, the sheets are moved to the binding position as being sandwiched by aligning faces 46*x* of the right-left pair of aligning devices 45 in a curved state as illustrated in FIG. 25C. Therefore, positional deviation is not caused by the operation to move the sheet bundle to the binding position. Then, the aligning device 45 moves the sheet bundle toward the downstream side in the sheet discharging direction by a predetermined amount with driving of the sheet bundle conveying device 60 (St32).

Figure 25D:
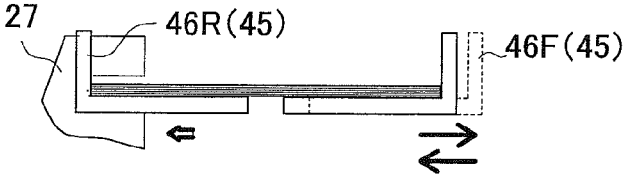
Figure 25E:
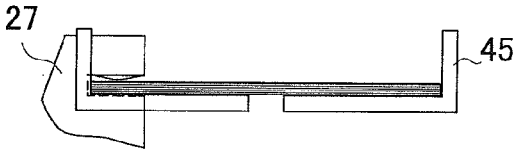
Figure 25F:
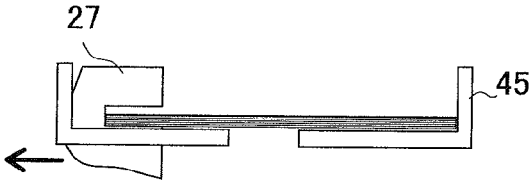
Figure 25G:
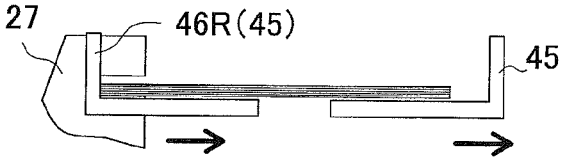
Figure 25H:
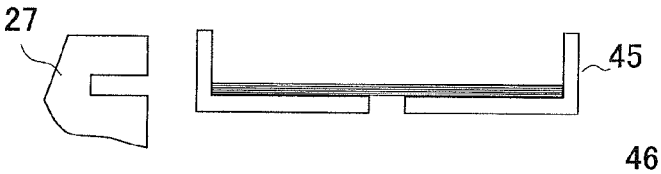
Figure 25I:
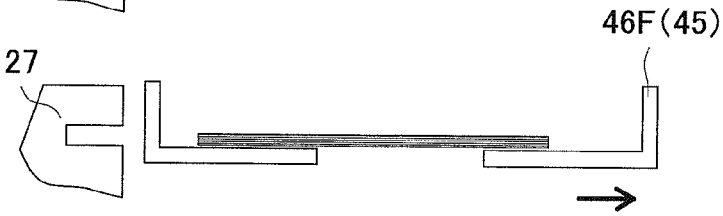

Concurrently with the above, the staple binding unit 26 is moved to the initial position and the sheet bundle guide is kept waiting at the retracting position above the processing tray 24 (St33). Next, the binding process controller 75 causes the right side aligning plate 46F to move to the home position (St34). FIG. 25D illustrates a state of performing a re-aligning process as reciprocating the right side aligning plate 46F. There is a fear that positional deviation occurs while the sheets are offset-moved from the alignment position to the binding position. Therefore, it is required to re-align the sheets for accurately performing a binding process thereon. In view of the above, the binding process controller 75 causes, in a state that the side aligning plate 46R located at the binding position side is stopped, the aligning plate 46F at the opposite side to perform an aligning operation as tapping the sheet side edge after moving to a position being apart from the sheets.

The binding process controller 75 transmits a command single to the press binding unit 27 to cause the binding process operation (FIG. 25E) to be performed (St35). After the binding process is completed, the binding process controller 75 operates a kick device structured with the side aligning plate 46R (at the apparatus rear side) located at the eco-binding position side. For example, if a sheet bundle is discharged in a kick direction by a nipping roller from the upper side of the sheet bundle, there arises a problem that only a sheet contacted to the roller is taken off and binding is released. Here, owing to that the kick device is structured with the side aligning plate 46R (in a case of right corner binding, the right side aligning plate 46F), a force in a taking-off direction can be applied to the whole sheet bundle for taking off the sheet bundle. Accordingly, binding is prevented from being released.

An operation of the side aligning plate 46R as the kick device will be described using FIG. 15. As illustrated in FIG. 15B, the binding process controller 75 causes the side aligning plate 46R to move, for back-swing of kicking, from a position being engaged with the sheet side edge to a position being apart therefrom. The movement amount of the back-swing is determined in consideration of a rising time (self-exciting time) of the aligning motor M6. That is, the overrun amount is determined in consideration of a rising time in which the motor provides a predetermined output torque as providing running time of the kicking to the side aligning plate 46R.

When a process end signal is received from the press binding unit 27, the binding process controller 75 causes the side aligning plate 46R to move toward the sheet center by a predetermined amount by driving the aligning motor M6 for the side aligning plate 46R (FIG. 15D). According to this operation, the sheet bundle pressure-nipped by the press binding unit 27 is taken off (FIG. 15E) and offset to the sheet center side by being kicked toward the eco-binding alignment position Ap2 from a state of being intimately contacted to the corrugation-shaped pressurizing faces (St37).

The kick operation will be described in detail in the following. The kick direction due to the side aligning plate 46R is preferably the same as the strip direction (rib direction) of the pressurizing faces or a direction being slightly inclined (for example, approximately by 0 to 30 degrees) to a plus or minus side with reference thereto. When a conveyance force is applied in a direction of arrow z in FIG. 15F (a direction perpendicular to the rib), the sheet bundle is likely to be unbound with the binding released. When a conveyance force is applied in a direction of arrow w in FIG. 15F, the sheet bundle is likely to be taken off from the pressurizing faces while the sheet bundle is kept bound. The angular direction is determined by experiment. In experiments, it is confirmed that setting the direction in a range between −30 degrees to 30 degrees with reference of the rib direction (0 degree) is preferable.

Further, in addition to the side aligning plate 46R, the kick device may additionally include a floating mechanism to float a bottom face of a sheet bundle from the pressurizing faces of the press binding unit 27. The floating mechanism (not illustrated) has a structure, for example, that a curved bottom piece to be engaged with the sheet bundle bottom face is arranged and an inclined cam face to protrude the curved bottom piece above the sheet placement face at the binding position is arranged at a back face of the processing tray 24 or the like. Further, a regulating face to be engaged with an end face of the sheet bundle on the sheet placement face is arranged at the side aligning plate 46R.

When the side aligning plate 46R of the kick device is moved to the back swing position of the sheet placement face, the curved bottom piece supports sheets at the same plane with the sheet placement face without receiving action of the inclined cam face. Subsequently, when the side aligning plate 46R is kick-moved toward the binding position Ep, the curved bottom piece pushes up the sheet bundle. At the same time, the regulating face provides action to push out an end face of the sheet bundle toward the sheet leading end. That is, the sheet bundle can be taken off reliably from the pressurizing faces by the curved bottom piece to push up the bound sheet bundle from the pressurizing face and the regulating face to push out the sheet bundle end edge toward the sheet center.

Similarly to the process described for the staple processing mode, when an operation completion signal is received from the press binding unit 27, the binding process controller 75 causes the sheet bundle discharging device 60 to operate to discharge the sheet bundle from the processing tray 24 toward the stack tray 25 at the downstream side (St21). When the sheet bundle discharging operation is completed, the binding process controller 75 moves the sheet bundle discharging device 60 to return to the initial position (St22). Concurrently with the above, the aligning device 46 is moved to return to the initial position (the waiting position to introduce a sheet to the processing tray 24) (St23). Further, the binding process controller 75 causes the drive motor to rotate the bundle holding device (elastic holding member) 53 arranged on the stack tray (St24), so that the upmost sheet of the sheet bundle introduced to the stack tray 25 is pressed and held (St25).

[Printout Sheet Discharging]

Figure 21:
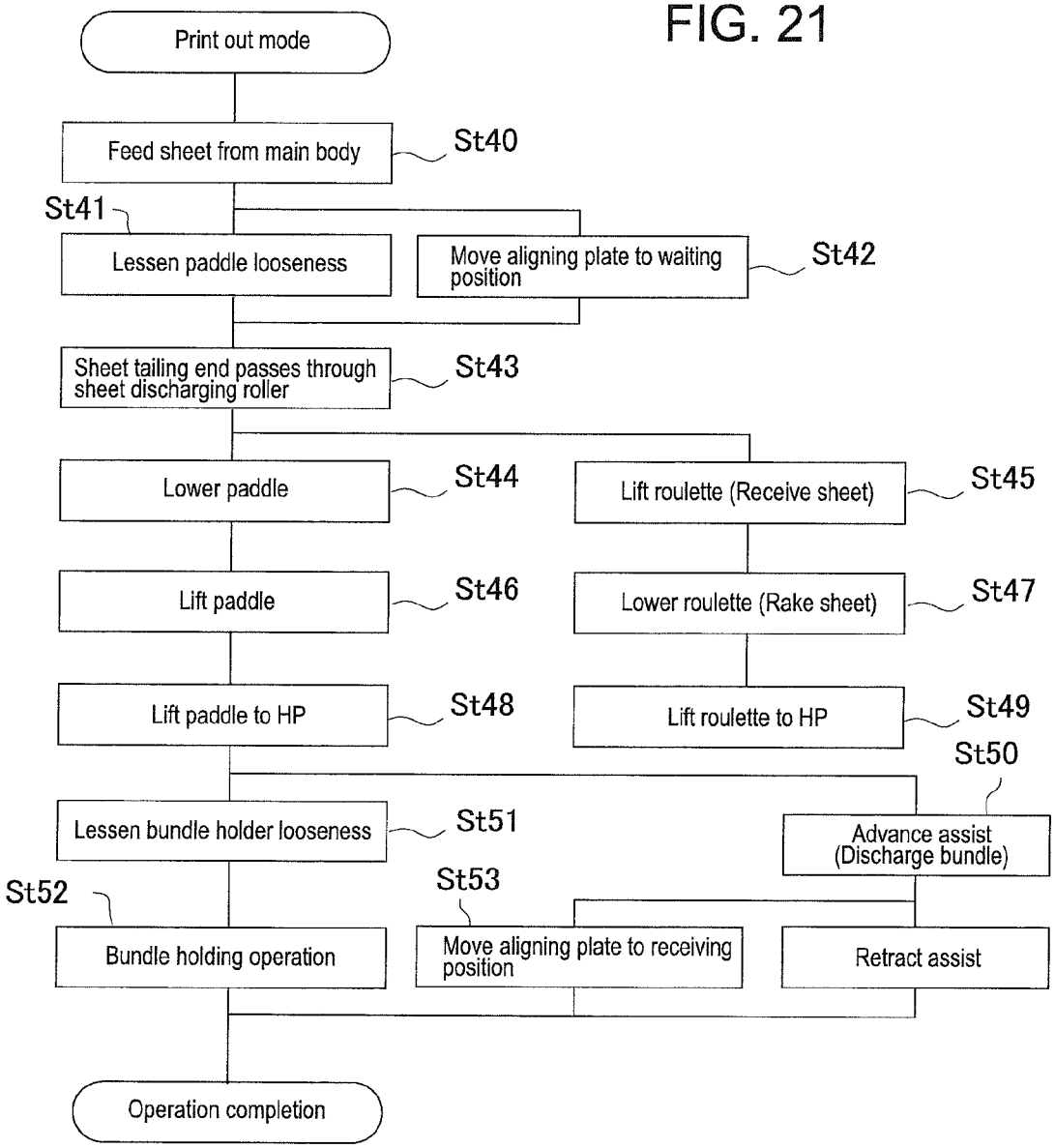
FIG. 21 is an operational flowchart of a printout mode.
Figure 22:
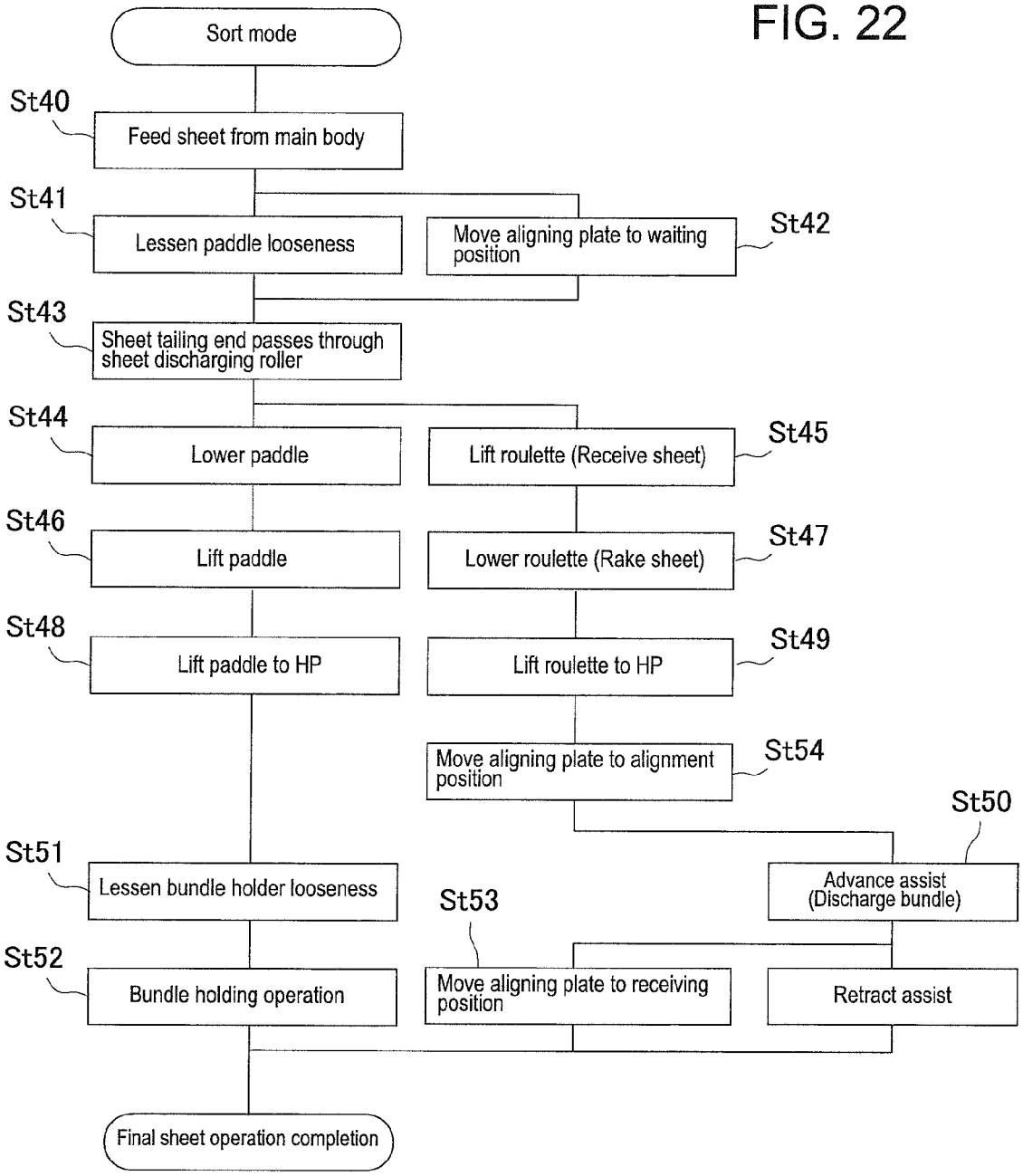
FIG. 22 is an operational flowchart of a sorting mode.

Description will be performed based on FIG. 21. When a sheet is discharged from the image forming unit A (St40), the sheet sensor detects a leading end thereof and the paddle rotor 36 is moved to the waiting position (St41). Concurrently with the above, the side aligning plates 46F, 46R are moved to the waiting positions (St42). Next, when the sheet tailing end passes through the sheet discharging roller 32 (St43), the binding process controller 75 lowers the paddle rotor 36 to the operating position (St44). Along with the above, the roulette rotor 33 is lifted to be retracted (St45).

When a predetermined time passes after the sheet tailing end passes through the sheet discharging roller 32, the binding process controller 75 lifts and moves the paddle rotor 36 to the retracting position (St46). Along with the above, the roulette rotor 33 is lowered to the operating position and feeds the sheet toward the tailing end regulating member 41 (St47). The binding process controller 75 moves the paddle rotor 36 to the home position at the time when the sheet tailing end is assumed to reach the tailing end regulating member 41 (St48). Further, the roulette rotor 33 is lifted to the home position (St49).

Then, the binding process controller 75 causes the side aligning plates 46F, 46R to move to the alignment position and perform the aligning operation. In the aligning operation, sheets having different sizes are stacked in center reference and fed to the stack tray 25 with the subsequent sheet discharging operation. In the printout sheet discharging operation, a later-mentioned non-standard size sheet discharging operation is performed when a large size sheet is introduced onto the tray.

According to the binding process controller 75, sheets are aligned and stacked on the processing tray 24 and the sheet bundle is discharged to the stack tray 25 at the downstream side. In the operation, the first conveying portion 60A of the sheet bundle discharging device 60 is moved in the sheet discharging direction (St50). Next, the tray sheet holding member 53 is moved to the waiting position (St51). Then, the upmost sheet is pressed by rotating the tray sheet holding member 53 by a predetermined angle at the timing when the sheet bundle is introduced onto the stack tray 25 (St52). Subsequently, the binding process controller 75 causes the side aligning plates 46F, 46R to return to the sheet introducing position (St53).

[Sort Mode]

In a sort mode, approximately the same steps are performed as in the printout mode. Here, description thereof is skipped with the same reference provided to the same step. In the following, different steps will be described. The binding process controller 75 causes sheets introduced onto the processing tray 24 to be stacked at different positions as being divided into a group whose sheets are aligned in center reference Sx and a group whose sheets are aligned in right side reference (St54). Then, the sheets are conveyed to the stack tray 25 at the downstream side as maintaining posture thereof. Here, the processing tray 24 is arranged at a position deviated to the apparatus front side and some sheets are aligned in right side reference. Then, sheets in center reference and sheets in right side reference biased toward an operator are stacked on the sheet placement face 24*a*. Accordingly, sheet bundles are easy to be removed from the stack tray 25.

[Common Operation in Respective Modes]

Figure 23:
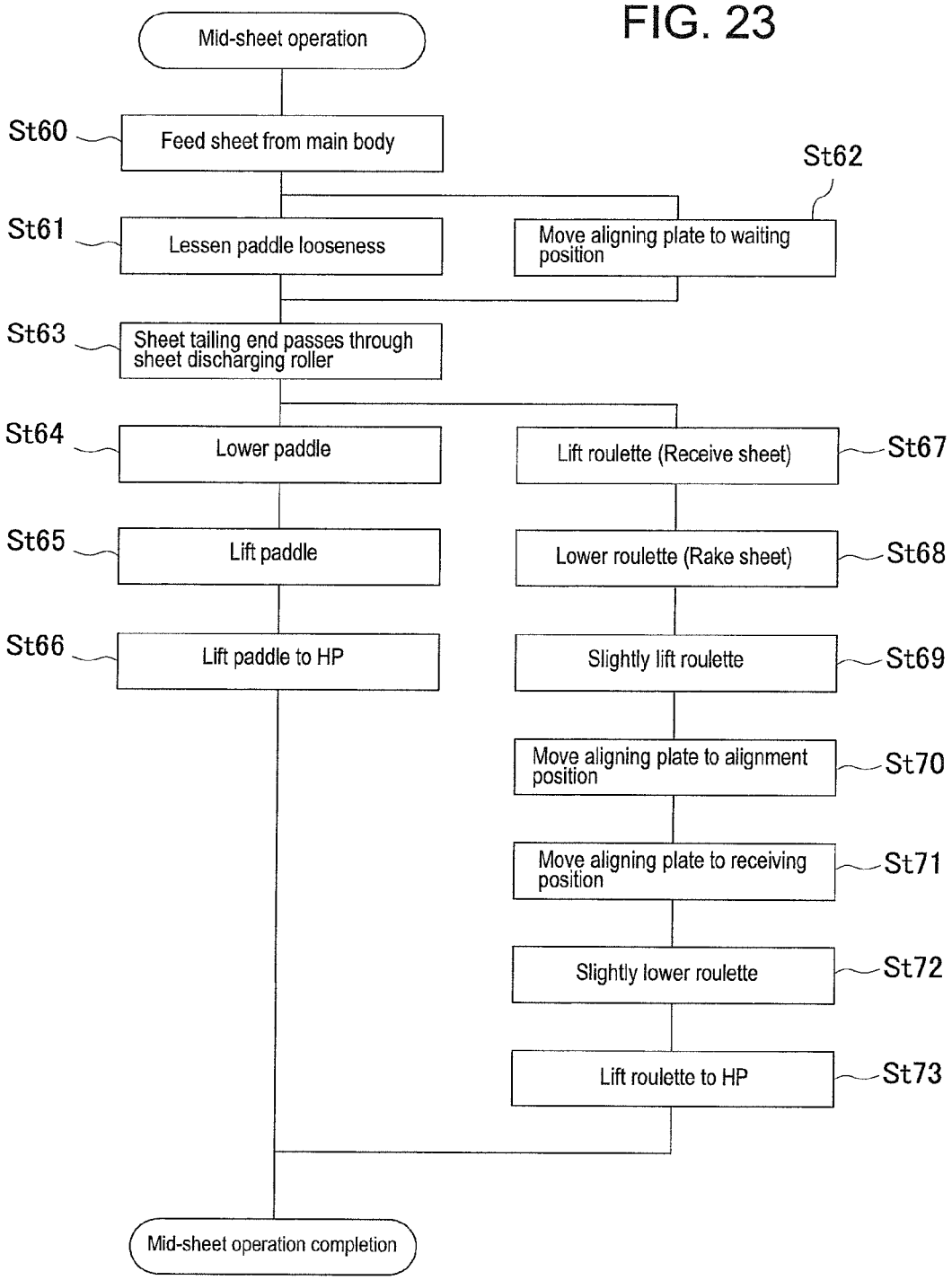
FIG. 23 is a common operational flowchart of introducing sheets onto a processing tray.

In the following, operation for introducing a sheet onto the processing tray 24 commonly performed in the abovementioned respective post-processing modes will be described with reference to FIG. 23. When a sheet is discharged from the image forming unit A (St60), the binding process controller 75 causes, with a leading end detection signal from the sheet sensor Se1, the paddle rotor 36 to be positioned at the waiting position (St61) and the predetermined aligning plate 45 to be moved to the waiting position (St62). In this operation, the aligning plate 45 is positioned at the waiting position to have a width size being slightly larger than the sheet size based on the sheet size signal sent from the image forming unit A.

Next, at the timing when the sheet tailing end passes through the sheet discharging roller 32 (St63), the binding process controller 75 causes the paddle rotor 36 to be lowered from the waiting position at the upper side to the operating position at the lower side (St64). Along with the above, the roulette rotor 34 is lowered from the waiting position above the sheet placement face 24*a* to the operating position on the sheet placement face 24*a* (St68). At that time, both of the paddle rotor 36 and the roulette rotor 34 are rotated in the direction opposite to the sheet discharging direction.

When a predetermined time (assumed time for the sheet tailing end to reach the position of the roulette rotor 34) passes, the binding process controller 75 causes the paddle rotor 36 to be lifted from the operating position to the waiting position (St65). When a predetermined time (assumed time for the sheet leading end to reach the tailing end regulating member) passes, the binding process controller 75 causes the roulette rotor 36 to be lifted by a small amount (St69). The lifting amount of the paddle rotor is previously set by experiment to reduce a pressing force against a sheet.

Next, the binding process controller 75 causes the side aligning plates 46F, 46R to move to the alignment position (St70). The alignment position is set to a different position in each binding processing mode, so that sheets are stacked at the abovementioned reference position in each mode, as described above.

(1) For multi-binding in the staple-binding processing mode, sheets introduced onto the processing tray 24 are aligned in center reference. For right corner binding, sheets introduced onto the processing tray 24 are aligned in right side reference Ap1. For left corner binding, sheets introduced onto the processing tray 24 are aligned in left side reference Ap2. In any case of the above, the staple binding unit 26 is prepared for the subsequent binding process operation as waiting at the binding position.

(2) In the eco-binding processing mode, the binding process controller 75 causes sheets to be aligned at the alignment position Ap3 defined at a position biased toward the sheet center from the eco-binding position or to be aligned in center reference.

(3) In the printout mode, the binding process controller 75 causes sheets to be aligned in center reference.

(4) In the jog processing mode, the binding process controller 75 causes the group being aligned in center reference and the group being aligned in right side reference to be alternately aligned in a repeated manner and to be discharged to the stack tray 25 as maintaining posture thereof.

Next, after the abovementioned aligning operation is completed, the binding process controller 75 causes the side aligning plates 46F, 46R to move to the initial position (St71), and then, the roulette rotor 34 to be lowered in a direction to press sheets (St72). Along with the above, the binding process controller 75 causes the paddle rotor 36 to be lifted to the waiting position as the home position and to stay thereat (St73).

[Manual Binding Operation]

Figure 24:
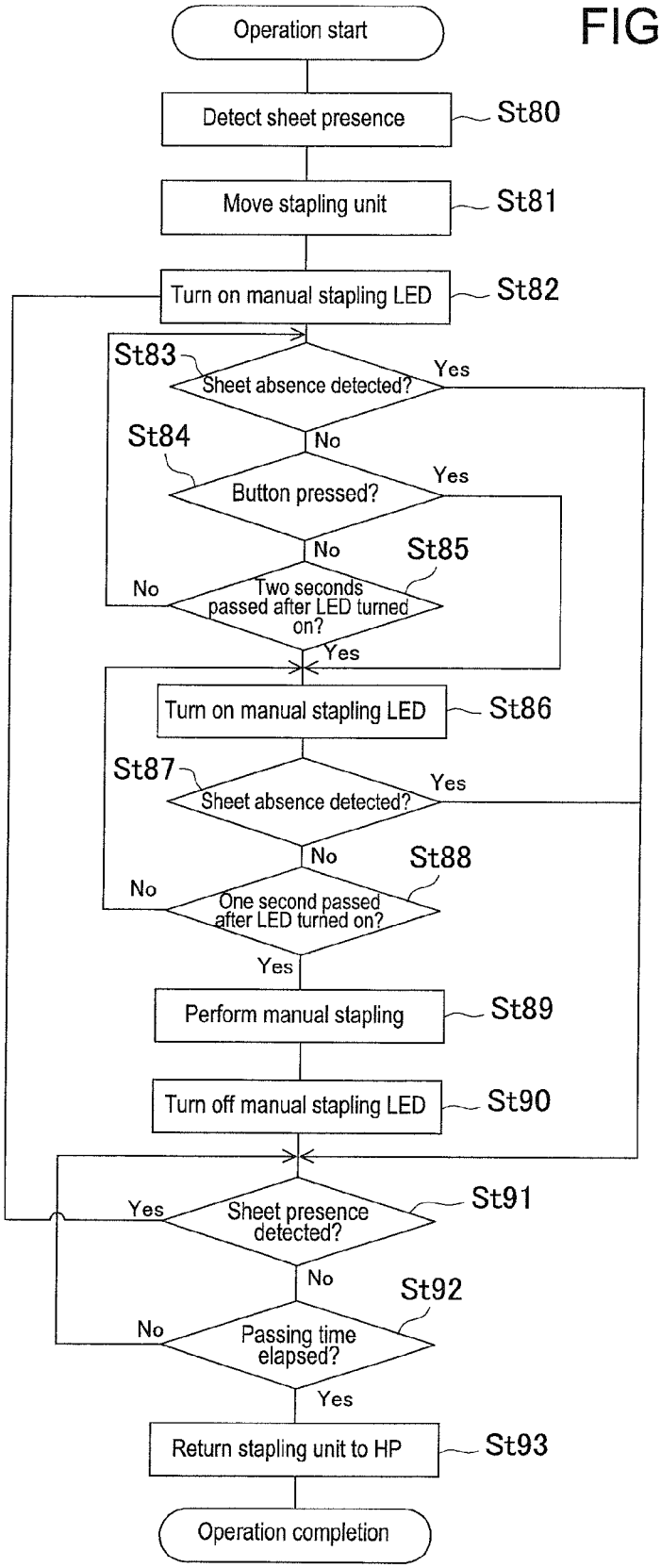
FIG. 24 is an operational flowchart of a manual staple binding process.

The manual binding operation will be described with reference to a flowchart in FIG. 24. A sheet presence-absence sensor Sm is arranged at the manual feeding portion. When the sheet presence-absence sensor Sm (hereinafter, called a sensor Sm) detects sheets, the binding process controller 75 causes the staple binding operation to be performed.

The binding process controller 75 determines whether or not the staple binding unit 26 is performing the binding process operation while the sensor Sm indicates an ON signal (St80). In a case of determining that the binding process operation can be interrupted, the staple binding unit 26 is moved to the manual binding position Mp (is kept staying when the stapling unit 26 is at the binding position) (St81). Then, an LED lamp is turned on to indicate that manual operation is running (St82).

Next, after confirming that the sensor Sm is ON (St83), the binding process controller 75 determines whether or not the operation button 30 is operated (St84). When the sensor Sm is ON or when a predetermined time passes (St85) after the LED lamp is turn on (in the drawing, the time is set to two seconds) even if the sensor Sm is OFF, the LED lamp is turned on again (St86). Then, after confirming that the sensor Sm is ON (St87), the binding process controller 75 further determines whether or not a predetermined time passes after the LED lamp is turned on. Then, the stapling operation is performed (St88).

Subsequently, when the sensor Sm is in an ON state after the stapling operation is performed, the binding process controller 75 performs the stapling operation again as returning to a predetermined step. According to the above, the binding process can be performed on a plurality of positions of a sheet bundle. When the sensor Sm detects a sheet-absence state and the sheet absence state continues even after a predetermined time, the staple binding unit 26 is returned to the home position as assuming that the sheets are removed from the setting face. Here, if the home position of the staple binding unit 26 is set at the manual binding position, the staple binding unit 26 stays thereat (St93).

In the present invention, during preparation or operation of the printout process, the jog sorting process, or the eco-binding process on the processing tray 24, the manual stapling operation is performed based on ON/OFF signals of the abovementioned sensor Sm. Further, during operation of the multi-binding operation or the corner binding operation on the processing tray 24, the manual operation can be performed when sheet stacking is in operation and a jog completion signal is not transmitted from the image forming unit A. Even if a jog completion signal is transmitted, the manual stapling operation is performed when an interruption process is instructed.

Thus, it is preferable for apparatus designing to adopt a device that determines which has a priority between the manual stapling operation and stapling operation on the processing tray 24 or that has an operator perform selection with a priority selection key.

What is claimed is:

1. A sheet bundle binding processing apparatus, comprising:

a stack portion on which sheets are stacked;

a first binding device which binds sheets stacked on the stack portion;

a second binding device which binds sheets stacked on the stack portion;

a moving portion moving a sheet on the stack portion to a first binding position where the first binding device binds sheets stacked on the stack portion, and to a second binding position where the second binding device binds sheets stacked on the stack portion;

a guide portion movable between a first position guiding a sheet on the stack portion to the second binding position, and a second position which is different from the first position; and a controller, and wherein in a first mode binding sheets stacked on the stack portion by the first binding device, the controller is configured to position the guide portion at the second position and to move a sheet on the stack portion to the first binding position by the moving portion, and to not position the guide portion at the first position when the sheets are aligned, and wherein in a second mode binding sheets stacked on the stack portion by the second binding device, the controller is configured to position the guide portion at the first position and to move a sheet on the stack portion to the second binding position by the moving portion.

2. The sheet bundle binding processing apparatus according to claim 1, wherein the first binding device is configured to be movable between a plurality of binding positions which are set within an introducing area of sheets fed from a sheet discharging port to the stack portion, and the second binding device is arranged at a position to perform a binding process on a side part of sheets.

3. The sheet bundle binding processing apparatus according to claim 2, wherein the first binding device is configured to be movable to a corner binding position to bind a sheet side edge same as the second binding device at an outside of the sheet introducing area of the stack portion, the controller causes sheets introduced onto the stack portion, in case that a binding process is performed by the first binding device, to be aligned and stacked at a corner binding position in a state that the first binding device is positioned at the corner binding position, and the controller performs a binding process, in case that a binding process is performed by the second binding device, after sheets on the stack portion are aligned and stacked at a position being apart from the second binding position toward a sheet center side and the sheets are offset-moved.

4. The sheet bundle binding processing apparatus according to claim 1, wherein the first binding device is a binding device using a staple, and the second binding device is a binding device without using a staple.

5. The sheet bundle binding processing apparatus according to claim 1, wherein the first binding device is configured to be movable to a corner binding position where a binding process is performed on a corner of the sheets stacked on the stack portion, and the second binding device is arranged at a position being apart by a predetermined amount from the corner binding position of the first binding device.

6. The sheet bundle binding processing apparatus according to claim 1, wherein the controller performs control such that in the second mode, in a case that a number of sheets stacked on the stack portion exceeds a previously-set number, the second binding device does not bind the sheets.

7. The sheet bundle binding processing apparatus according to claim 1, wherein the controller performs control so that sheets bound by the second binding device are offset by the moving portion by a predetermined amount toward a sheet center side as intersecting with a sheet discharging direction of sheet discharged on the stack portion.

8. The sheet bundle binding processing apparatus according to claim 1, further comprising a regulating portion which regulates a sheet transported in a predetermined discharging direction and discharged on the stack portion with a tailing end edge of the sheet abutted thereto, and a sheet offset portion moving sheet on the stack portion in a direction crossing the sheet discharging direction, wherein the second binding device is arranged between the regulating portion and the sheet offset portion in the sheet discharging direction.

9. The sheet bundle binding processing apparatus according to claim 1, wherein, in the second mode, the controller prohibits from operating in a case that a number of sheets on the stack portion exceeds or is expected to exceed a previously-set number.

10. The sheet bundle binding processing apparatus according to claim 1, wherein the second binding device has capability to bind a fewer number of sheets than that of the first binding device.

11. The sheet bundle binding processing apparatus according to claim 1, wherein the second position is disposed above the first position.

12. A sheet bundle binding processing apparatus, comprising:

a stack portion on which sheets are stacked;

an aligning device which aligns sheets stacked on the stack portion;

a first binding device which binds sheets stacked on the stack portion;

a second binding device which binds sheets stacked on the stack portion having capability to bind a fewer number of sheets than that of the first binding device; and a controller which controls the aligning device so that sheets stacked on the stack portion are aligned at a position being apart from the second binding device by a predetermined distance before the sheets are bound by the second binding device, wherein the first binding device is configured to be movable between a plurality of binding positions which are set within an introducing area of sheets fed from a sheet discharging port to the stack portion, the second binding device is arranged at a position to perform a binding process on a side part of a sheet bundle being apart by a predetermined amount from the sheet introducing area of the sheet discharging port in a direction perpendicular to a sheet discharging direction, the controller performs control, in case that a binding process is performed by the first binding device, so that sheets are stacked on the stack portion in a state that the first binding device is located in the sheet introducing area, aligning is performed at a position where the sheets are stacked from the sheet discharging port onto the stack portion, and the binding process is performed on the sheets, and the controller performs control, in case that a binding process is performed by the second binding device, so that sheets are moved toward the second binding device by the aligning device after being aligned, and then, the binding process is performed thereon.

13. A sheet bundle binding processing apparatus, comprising:

a stack portion on which sheets are stacked;

a first binding device which binds sheets stacked on the stack portion;

a second binding device which binds sheets stacked on the stack portion;

a moving portion moving a sheet on the stack portion to a first binding position where the first binding device binds sheets stacked on the stack portion, and to a second binding position where the second binding device binds sheets stacked on the stack portion;

a guide portion movable between a first position guiding a sheet on the stack portion to the second binding position, and a second position which is different from the first position, the guide portion engaging an edge of a sheet moved by the moving portion to guide the sheet; and a controller, and wherein in a first mode binding sheets stacked on the stack portion by the first binding device, the controller is configured to position the guide portion at the second position and to move a sheet on the stack portion to the first binding position by the moving portion, and wherein in a second mode binding sheets stacked on the stack portion by the second binding device, the controller is configured to position the guide portion at the first position and to move a sheet on the stack portion to the second binding position by the moving portion.

* * * * *